US010760002B2

(12) United States Patent
Ball et al.

(10) Patent No.: US 10,760,002 B2
(45) Date of Patent: Sep. 1, 2020

(54) SYSTEMS AND METHODS FOR MAINTAINING A HOT CAR IN A COKE PLANT

(71) Applicant: SUNCOKE TECHNOLOGY AND DEVELOPMENT LLC, Lisle, IL (US)

(72) Inventors: Mark Anthony Ball, Lisle, IL (US); Cedino Renato De Lima, Serra ES (BR); Charles Humberto Effgen Wernesbach, Serra ES (BR); Jose Sidnei Nossa, Serra ES (BR); Wander Martins Souza, Serra ES (BR); Chun Wai Choi, Lisle, IL (US); Amilton Borghi, Serra ES (BR)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 283 days.

(21) Appl. No.: 14/655,003

(22) PCT Filed: Dec. 28, 2012

(86) PCT No.: PCT/US2012/072171
§ 371 (c)(1),
(2) Date: Jun. 23, 2015

(87) PCT Pub. No.: WO2014/105063
PCT Pub. Date: Jul. 3, 2014

(65) Prior Publication Data
US 2015/0361347 A1 Dec. 17, 2015

(51) Int. Cl.
*C10B 39/04* (2006.01)
*C10B 39/12* (2006.01)
*C10B 39/14* (2006.01)

(52) U.S. Cl.
CPC ..... *C10B 39/14* (2013.01); *C10B 39/12* (2013.01); *C10B 39/04* (2013.01)

(58) Field of Classification Search
CPC ..... C10B 39/14; C10B 39/04; C10B 39/06; C10B 39/08; C10B 39/00; C10B 39/12; C10B 39/16; C10B 3/18
See application file for complete search history.

(56) References Cited

U.S. PATENT DOCUMENTS 425,797 A * 4/1890 Hunt ..... C10B 39/14 105/270
469,867 A * 3/1892 Osbourn ..... C10B 39/14 202/227

(Continued)

FOREIGN PATENT DOCUMENTS

CA 1172895 8/1984
CA 2775992 A1 5/2011

(Continued)

OTHER PUBLICATIONS

Espacenet translation of DE 3,231,697.*

(Continued)

*Primary Examiner* — Jonathan Luke Pilcher
(74) *Attorney, Agent, or Firm* — Perkins Coie LLP

(57) ABSTRACT

The present technology describes various embodiments of systems and methods for maintaining a flat push hot car. In some embodiments, the flat push hot car includes an at least partially enclosed hot box having an interior portion, an exterior portion, a base, and a plurality of sidewalls extending upward from the base. The hot box can be coupled to or integrated with a fluid distribution system. The fluid distribution system can include a spray manifold having one or more inlets configured to release a fluid directed toward the sidewalls of the interior portion so as to provide regional cooling to the hot box.

18 Claims, 10 Drawing Sheets

(56) References Cited

U.S. PATENT DOCUMENTS 469,868 A 3/1892 Thomas et al.
845,719 A 2/1907 Schniewind
976,580 A * 11/1910 Krause ..... C10B 39/14 202/227
1,140,798 A 5/1915 Carpenter
1,424,777 A 8/1922 Schondeling
1,430,027 A 9/1922 Plantinga
1,486,401 A 3/1924 Van Ackeren
1,530,995 A 3/1925 Geiger
1,572,391 A 2/1926 Klaiber
1,677,973 A 7/1928 Marquard
1,705,039 A 3/1929 Thornhill
1,721,813 A 7/1929 Rudolf et al.
1,757,682 A 5/1930 Palm
1,818,370 A 8/1931 Wine
1,818,994 A 8/1931 Kreisinger
1,830,951 A 11/1931 Lovett
1,848,818 A 3/1932 Becker
1,947,499 A 2/1934 Schrader et al.
1,955,962 A 4/1934 Jones
2,075,337 A 3/1937 Burnaugh
2,141,035 A 12/1938 Daniels
2,195,466 A 4/1940 Otto
2,394,173 A 2/1946 Harris
2,424,012 A 7/1947 Bangham et al.
2,649,978 A 8/1953 Such
2,667,185 A 1/1954 Beavers
2,723,725 A 11/1955 Keiffer
2,756,842 A 7/1956 Chamberlin et al.
2,813,708 A 11/1957 Frey
2,827,424 A 3/1958 Homan
2,873,816 A 2/1959 Emil et al.
2,902,991 A 9/1959 Whitman
2,907,698 A 10/1959 Schulz
3,015,893 A 1/1962 McCreary
3,033,764 A 5/1962 Hannes
3,224,805 A 12/1965 Clyatt
3,462,345 A 8/1969 Kernan
3,511,030 A 5/1970 Brown et al.
3,542,650 A 11/1970 Kulakov
3,545,470 A 12/1970 Paton
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,811,572 A * 5/1974 Tatterson ..... B01D 21/00 210/167.31
3,836,161 A 9/1974 Buhl
3,839,156 A 10/1974 Jakobi et al.
3,844,900 A 10/1974 Schulte
3,857,758 A 12/1974 Mole
3,875,016 A 4/1975 Schmidt-Balve et al.
3,876,143 A 4/1975 Rossow et al.
3,876,506 A 4/1975 Ernst et al.
3,878,053 A 4/1975 Hyde
3,894,302 A 7/1975 Lasater
3,897,312 A 7/1975 Armour
3,906,992 A 9/1975 Leach
3,912,091 A 10/1975 Thompson
3,917,458 A 11/1975 Polak
3,928,144 A 12/1975 Jakimowicz
3,930,961 A 1/1976 Sustarsic et al.
3,933,443 A 1/1976 Lohrmann
3,957,591 A 5/1976 Riecker
3,959,084 A 5/1976 Price
3,963,582 A 6/1976 Helm et al.
3,969,191 A 7/1976 Bollenbach et al.
3,975,148 A 8/1976 Fukuda et al.
3,984,289 A 10/1976 Sustarsic et al.
4,004,702 A 1/1977 Szendroi
4,004,983 A 1/1977 Pries
4,025,395 A 5/1977 Ekholm et al.
4,040,910 A 8/1977 Knappstein et al.
4,045,299 A 8/1977 MacDonald
4,059,885 A 11/1977 Oldengott
4,067,462 A 1/1978 Thompson
4,083,753 A 4/1978 Rogers et al.
4,086,231 A 4/1978 Ikio
4,093,245 A 6/1978 Connor
4,100,033 A 7/1978 Holter
4,111,757 A 9/1978 Ciarimboli
4,124,450 A 11/1978 MacDonald
4,135,948 A 1/1979 Mertens et al.
4,141,796 A 2/1979 Clark et al.
4,145,195 A 3/1979 Knappstein et al.
4,147,230 A 4/1979 Ormond et al.
4,162,546 A 7/1979 Shortell et al.
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy et al.
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,235,830 A 11/1980 Bennett et al.
4,239,602 A 12/1980 La Bate
4,248,671 A 2/1981 Belding
4,249,997 A 2/1981 Schmitz
4,263,099 A 4/1981 Porter
4,268,360 A 5/1981 Tsuzuki et al.
4,271,814 A 6/1981 Lister
4,284,478 A 8/1981 Brommel
4,285,772 A 8/1981 Kress
4,287,024 A 9/1981 Thompson
4,289,584 A 9/1981 Chuss et al.
4,289,585 A 9/1981 Wagener et al.
4,296,938 A 10/1981 Offermann et al.
4,299,666 A 11/1981 Ostmann
4,302,935 A 12/1981 Cousimano
4,303,615 A 12/1981 Jarmell et al.
4,307,673 A 12/1981 Caughey
4,314,787 A 2/1982 Kwasnick et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,353,189 A 10/1982 Thiersch et al.
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,394,217 A 7/1983 Holz et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Wirtschafter
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh

(56) References Cited

U.S. PATENT DOCUMENTS 4,506,025 A 3/1985 Kleeb et al.
4,508,539 A 4/1985 Nakai
4,527,488 A 7/1985 Lindgren
4,564,420 A 1/1986 Spindeler et al.
4,568,426 A 2/1986 Orlando et al.
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando et al.
4,704,195 A 11/1987 Janicka et al.
4,720,262 A 1/1988 Durr et al.
4,724,976 A 2/1988 Lee
4,726,465 A 2/1988 Kwasnik et al.
4,793,931 A 12/1988 Doyle et al.
4,824,614 A 4/1989 Jones et al.
4,889,698 A 12/1989 Moller et al.
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childrss et al.
5,213,138 A 5/1993 Presz
5,227,106 A 7/1993 Kolvek
5,228,955 A 7/1993 Westbrook
5,234,601 A 8/1993 Janke et al.
5,318,671 A 6/1994 Pruitt
5,370,218 A 12/1994 Johnson et al.
5,423,152 A 6/1995 Kolvek
5,447,606 A 9/1995 Prutt et al.
5,480,594 A 1/1996 Wilkerson et al.
5,542,650 A 8/1996 Abel et al.
5,622,280 A 4/1997 Mays et al.
5,659,110 A 8/1997 Herden et al.
5,670,025 A 9/1997 Baird
5,687,768 A 11/1997 Albrecht et al.
5,715,962 A 2/1998 McDonnell
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,913,448 A 6/1999 Mann et al.
5,928,476 A 7/1999 Daniels
5,968,320 A 10/1999 Sprague
6,017,214 A 1/2000 Sturgulewski
6,059,932 A 5/2000 Sturgulewski
6,139,692 A 10/2000 Tamura et al.
6,152,668 A 11/2000 Knoch
6,187,148 B1 2/2001 Sturgulewski
6,189,819 B1 2/2001 Racine
6,290,494 B1 9/2001 Barkdoll
6,412,221 B1 7/2002 Emsbo
6,596,128 B2 7/2003 Westbrook
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
6,964,236 B2 11/2005 Schucker
7,056,390 B2 6/2006 Fratello
7,077,892 B2 7/2006 Lee
7,314,060 B2 1/2008 Chen et al.
7,331,298 B2 2/2008 Taylor et al.
7,433,743 B2 10/2008 Pistikopoulos et al.
7,497,930 B2 3/2009 Barkdoll et al.
7,611,609 B1 11/2009 Valia et al.
7,644,711 B2 1/2010 Creel
7,722,843 B1 5/2010 Srinivasachar
7,727,307 B2 6/2010 Winkler
7,785,447 B2 8/2010 Eatough et al.
7,803,627 B2 9/2010 Hodges
7,823,401 B2 11/2010 Takeuchi et al.
7,827,689 B2 11/2010 Crane et al.
7,998,316 B2 8/2011 Barkdoll et al.
8,071,060 B2 12/2011 Ukai et al.
8,079,751 B2 12/2011 Kapila et al.
8,080,088 B1 12/2011 Srinivasachar
8,152,970 B2 4/2012 Barkdoll et al.
8,236,142 B2 8/2012 Westbrook et al.
8,266,853 B2 9/2012 Bloom et al.
8,398,935 B2 3/2013 Howell, Jr. et al.
8,409,405 B2 4/2013 Kim et al.
8,647,476 B2 2/2014 Kim et al.
8,800,795 B2 8/2014 Hwang
8,956,995 B2 2/2015 Masatsugu et al.
8,980,063 B2 3/2015 Kim et al.
9,039,869 B2 5/2015 Kim et al.
9,057,023 B2 6/2015 Reichelt et al.
9,193,915 B2 11/2015 West et al.
10,323,192 B2 6/2019 Quanci et al.
2002/0170605 A1 11/2002 Shiraishi et al.
2003/0014954 A1 1/2003 Ronning et al.
2003/0015809 A1 1/2003 Carson
2003/0057083 A1 3/2003 Eatough et al.
2005/0087767 A1 4/2005 Fitzgerald et al.
2006/0102420 A1 5/2006 Huber et al.
2006/0149407 A1 7/2006 Markham et al.
2007/0116619 A1 5/2007 Taylor et al.
2007/0251198 A1 11/2007 Witter
2008/0028935 A1 2/2008 Andersson
2008/0169578 A1 7/2008 Crane et al.
2008/0179165 A1 7/2008 Chen et al.
2008/0257236 A1 10/2008 Green
2008/0271985 A1 11/2008 Yamasaki
2008/0289305 A1 11/2008 Girondi
2009/0007785 A1 1/2009 Kimura et al.
2009/0152092 A1 6/2009 Kim et al.
2009/0162269 A1 6/2009 Barger et al.
2009/0217576 A1 9/2009 Kim et al.
2009/0283395 A1 11/2009 Hippe
2010/0095521 A1 4/2010 Bertini et al.
2010/0106310 A1 4/2010 Grohman
2010/0113266 A1 5/2010 Abe et al.
2010/0115912 A1 5/2010 Worley et al.
2010/0181297 A1 7/2010 Whysail
2010/0196597 A1 8/2010 Di Loreto
2010/0236914 A1* 9/2010 Barkdoll ..... C10B 39/04 201/35
2010/0276269 A1 11/2010 Schuecker et al.
2010/0287871 A1 11/2010 Bloom et al.
2010/0300867 A1 12/2010 Kim et al.
2010/0314234 A1 12/2010 Knoch et al.
2011/0048917 A1 3/2011 Kim et al.
2011/0088600 A1 4/2011 McRae
2011/0120852 A1 5/2011 Kim et al.
2011/0144406 A1 6/2011 Masatsugu et al.
2011/0168482 A1 7/2011 Merchant et al.
2011/0174301 A1 7/2011 Haydock et al.
2011/0192395 A1 8/2011 Kim et al.
2011/0198206 A1 8/2011 Kim et al.
2011/0223088 A1 9/2011 Chang et al.
2011/0253521 A1 10/2011 Kim
2011/0291827 A1 12/2011 Baldocchi et al.
2011/0313218 A1 12/2011 Dana
2011/0315538 A1 12/2011 Kim et al.
2012/0024688 A1 2/2012 Barkdoll
2012/0030998 A1 2/2012 Barkdoll et al.
2012/0125709 A1 5/2012 Merchant et al.
2012/0152720 A1 6/2012 Reichelt et al.
2012/0180133 A1 7/2012 Al-Harbi et al.
2012/0228115 A1 9/2012 Westbrook
2012/0247939 A1 10/2012 Kim et al.
2012/0305380 A1 12/2012 Wang et al.
2013/0020781 A1 1/2013 Kishikawa
2013/0045149 A1 2/2013 Miller
2013/0216717 A1 8/2013 Rago et al.
2013/0220373 A1 8/2013 Kim

(56) References Cited

U.S. PATENT DOCUMENTS

| | | | |
|---|---|---|---|
| 2013/0306462 | A1 | 11/2013 | Kim |
| 2014/0033917 | A1 | 2/2014 | Rodgers et al. |
| 2014/0039833 | A1 | 2/2014 | Sharpe, Jr. et al. |
| 2014/0048402 | A1 | 2/2014 | Quanci et al. |
| 2014/0048404 | A1 | 2/2014 | Quanci et al. |
| 2014/0048405 | A1 | 2/2014 | Quanci et al. |
| 2014/0061018 | A1 | 3/2014 | Sarpen et al. |
| 2014/0083836 | A1 | 3/2014 | Quanci et al. |
| 2014/0182195 | A1 | 7/2014 | Quanci et al. |
| 2014/0182683 | A1 | 7/2014 | Quanci et al. |
| 2014/0183023 | A1 | 7/2014 | Quanci et al. |
| 2014/0183024 | A1 | 7/2014 | Chun et al. |
| 2014/0183026 | A1 | 7/2014 | Quanci et al. |
| 2014/0208997 | A1 | 7/2014 | Alferyev et al. |
| 2014/0224123 | A1 | 8/2014 | Walters |
| 2014/0262139 | A1 | 9/2014 | Choi et al. |
| 2014/0262726 | A1 | 9/2014 | West et al. |
| 2015/0122629 | A1 | 5/2015 | Freimuth et al. |
| 2015/0219530 | A1 | 8/2015 | Li et al. |
| 2015/0247092 | A1 | 9/2015 | Quanci et al. |
| 2015/0287026 | A1 | 10/2015 | Yang et al. |
| 2016/0026193 | A1 | 1/2016 | Rhodes et al. |
| 2016/0048139 | A1 | 2/2016 | Samples et al. |
| 2016/0149944 | A1 | 5/2016 | Obermeier et al. |
| 2017/0015908 | A1 | 1/2017 | Quanci et al. |
| 2018/0340122 | A1 | 11/2018 | Crum et al. |

FOREIGN PATENT DOCUMENTS

| | | | | |
|---|---|---|---|---|
| CA | 2822841 | | 7/2012 | |
| CA | 2822857 | A1 | 7/2012 | |
| CN | 87212113 | U | 6/1988 | |
| CN | 87107195 | A | 7/1988 | |
| CN | 2064363 | U | 10/1990 | |
| CN | 2139121 | y | 7/1993 | |
| CN | 1092457 | A | 9/1994 | |
| CN | 1255528 | A | 6/2000 | |
| CN | 1270983 | A | 10/2000 | |
| CN | 1358822 | A | 7/2002 | |
| CN | 2509188 | Y | 9/2002 | |
| CN | 2521473 | Y | 11/2002 | |
| CN | 2528771 | Y | 1/2003 | |
| CN | 1468364 | A | 1/2004 | |
| CN | 1527872 | A | 9/2004 | |
| CN | 2668641 | Y | 1/2005 | |
| CN | 1957204 | A | 5/2007 | |
| CN | 101037603 | A | 9/2007 | |
| CN | 101058731 | A | 10/2007 | |
| CN | 101157874 | A | 4/2008 | |
| CN | 201121178 | Y | 9/2008 | |
| CN | 101395248 | A | 3/2009 | |
| CN | 100510004 | C | 7/2009 | |
| CN | 101486017 | A | 7/2009 | |
| CN | 201264981 | Y | 7/2009 | |
| CN | 101497835 | A | 8/2009 | |
| CN | 101509427 | A | 8/2009 | |
| CN | 102155300 | A | 8/2011 | |
| CN | 202226816 | U | 5/2012 | |
| CN | 202265541 | U | 6/2012 | |
| CN | 102584294 | A | 7/2012 | |
| CN | 202415446 | U | 9/2012 | |
| CN | 103468289 | A | 12/2013 | |
| CN | 105189704 | A | 12/2015 | |
| CN | 106661456 | A | 5/2017 | |
| DE | 201729 | C | 9/1908 | |
| DE | 212176 | C | 7/1909 | |
| DE | 1212037 | B | 3/1966 | |
| DE | 3315738 | A1 | 11/1983 | |
| DE | 3231697 | C1 * | 1/1984 | ..... C10B 39/04 |
| DE | 3231697 | C1 | 1/1984 | |
| DE | 3329367 | C1 | 11/1984 | |
| DE | 3328702 | A1 | 2/1985 | |
| DE | 3407487 | C1 | 6/1985 | |
| DE | 19545736 | A1 | 6/1997 | |
| DE | 19803455 | C1 | 8/1999 | |
| DE | 10122531 | A1 | 11/2002 | |
| DE | 10154785 | A1 | 5/2003 | |
| DE | 102005015301 | | 10/2006 | |
| DE | 102006004669 | | 8/2007 | |
| DE | 102006026521 | A1 | 12/2007 | |
| DE | 102009031436 | A1 | 1/2011 | |
| DE | 102011052785 | B3 | 12/2012 | |
| EP | 0126399 | A1 | 11/1984 | |
| EP | 0208490 | | 1/1987 | |
| EP | 0903393 | A2 | 3/1999 | |
| EP | 1538503 | A1 | 6/2005 | |
| EP | 2295129 | | 3/2011 | |
| FR | 2339664 | A1 | 8/1977 | |
| GB | 364236 | A * | 1/1932 | ..... C10B 39/04 |
| GB | 368649 | A | 3/1932 | |
| GB | 441784 | A | 1/1936 | |
| GB | 606340 | A | 8/1948 | |
| GB | 611524 | A | 11/1948 | |
| GB | 725865 | A | 3/1955 | |
| GB | 871094 | A | 6/1961 | |
| GB | 923205 | A | 5/1963 | |
| JP | 50148405 | A | 11/1975 | |
| JP | S59019301 | | 2/1978 | |
| JP | 54054101 | A | 4/1979 | |
| JP | S5453103 | A | 4/1979 | |
| JP | 57051786 | A | 3/1982 | |
| JP | 57051787 | A | 3/1982 | |
| JP | 57083585 | A | 5/1982 | |
| JP | 57090092 | A | 6/1982 | |
| JP | 58091788 | A | 5/1983 | |
| JP | 59051978 | A | 3/1984 | |
| JP | 59053589 | A | 3/1984 | |
| JP | 59071388 | A | 4/1984 | |
| JP | 59108083 | A | 6/1984 | |
| JP | 59145281 | A | 8/1984 | |
| JP | 60004588 | A | 1/1985 | |
| JP | 61106690 | A | 5/1986 | |
| JP | 62011794 | A | 1/1987 | |
| JP | 62285980 | A | 12/1987 | |
| JP | 01103694 | A | 4/1989 | |
| JP | 01249886 | A | 10/1989 | |
| JP | H0319127 | A | 1/1991 | |
| JP | H04178494 | A | 6/1992 | |
| JP | H0649450 | A | 2/1994 | |
| JP | H0654753 | U | 7/1994 | |
| JP | 06264062 | | 9/1994 | |
| JP | 07188668 | A | 7/1995 | |
| JP | 07216357 | A | 8/1995 | |
| JP | H07204432 | | 8/1995 | |
| JP | H08104875 | A | 4/1996 | |
| JP | 08127778 | A | 5/1996 | |
| JP | H10273672 | A | 10/1998 | |
| JP | H11-131074 | | 5/1999 | |
| JP | 2000204373 | A | 7/2000 | |
| JP | 2001200258 | A | 7/2001 | |
| JP | 03197588 | A | 8/2001 | |
| JP | 2002106941 | A | 4/2002 | |
| JP | 200341258 | A | 2/2003 | |
| JP | 2003071313 | A | 3/2003 | |
| JP | 2003292968 | A | 10/2003 | |
| JP | 2003342581 | A | 12/2003 | |
| JP | 2005503448 | A | 2/2005 | |
| JP | 2005263983 | A | 9/2005 | |
| JP | 2006188608 | A | 7/2006 | |
| JP | 2007063420 | A | 3/2007 | |
| JP | 4101226 | B2 | 6/2008 | |
| JP | 04159392 | A | 10/2008 | |
| JP | 2008231278 | A | 10/2008 | |
| JP | 2009073864 | A | 4/2009 | |
| JP | 2009073865 | A | 4/2009 | |
| JP | 2009144121 | A | 7/2009 | |
| JP | 2010229239 | A | 10/2010 | |
| JP | 2010248389 | A | 11/2010 | |
| JP | 2012102302 | A | 5/2012 | |
| JP | 2013006957 | A | 1/2013 | |
| JP | 2013510910 | | 3/2013 | |
| JP | 2013189322 | A | 9/2013 | |
| JP | 2014040502 | A | 3/2014 | |
| KR | 1019990054426 | A | 7/1999 | |

(56) References Cited

FOREIGN PATENT DOCUMENTS

| | | | |
|---|---|---|---|
| KR | 20000042375 | A | 7/2000 |
| KR | 100296700 | B1 | 10/2001 |
| KR | 1020050053861 | A | 6/2005 |
| KR | 100737393 | B1 | 7/2007 |
| KR | 100797852 | B1 | 1/2008 |
| KR | 10-2011-0010452 | A | 2/2011 |
| KR | 101314288 | | 4/2011 |
| KR | 10-0296700 | A1 | 10/2011 |
| KR | 20130050807 | | 5/2013 |
| KR | 101318388 | B1 | 10/2013 |
| RU | 2083532 | C1 | 7/1997 |
| RU | 2441898 | C2 | 2/2012 |
| SU | 1535880 | A1 | 1/1990 |
| TW | 201241166 | A | 10/2012 |
| TW | 201245431 | A1 | 11/2012 |
| UA | 50580 | | 10/2002 |
| WO | 9012074 | A1 | 10/1990 |
| WO | 9945083 | A1 | 9/1999 |
| WO | WO2005023649 | | 3/2005 |
| WO | WO2005115583 | | 12/2005 |
| WO | 2007103649 | A2 | 9/2007 |
| WO | 2008034424 | A1 | 3/2008 |
| WO | 2010107513 | A1 | 9/2010 |
| WO | 2011000447 | A1 | 1/2011 |
| WO | 2012029979 | A1 | 3/2012 |
| WO | WO2012031726 | | 3/2012 |
| WO | 2013023872 | A1 | 2/2013 |
| WO | WO2014021909 | | 2/2014 |
| WO | WO2014043667 | | 3/2014 |
| WO | 2014105064 | A1 | 7/2014 |
| WO | WO2014153050 | | 9/2014 |
| WO | 2016004106 | A1 | 1/2016 |

OTHER PUBLICATIONS

U.S. Appl. No. 14/655,013, filed Jun. 23, 2015, West, Gary D., et al.
U.S. Appl. No. 14/655,204, filed Jun. 24, 2015, Quanci, John F., et al.
U.S. Appl. No. 14/839,384, filed Aug. 28, 2015, Quanci, John F., et al.
U.S. Appl. No. 14/839,493, filed Aug. 28, 2015, Quanci, John F., et al.
U.S. Appl. No. 14/839,551, filed Aug. 28, 2015, Quanci, John F., et al.
U.S. Appl. No. 14/839,588, filed Aug. 28, 2015, Quanci, John F., et al.
U.S. Appl. No. 14/865,581, filed Sep. 25, 2015, Sarpen, Jacob P., et al.
ASTM D5341-99(2010)e1, Standard Test Method for Measuring Coke Reactivity Index (CRI) and Coke Strength After Reaction (CSR), ASTM International, West Conshohocken, PA, 2010.
Clean coke process: process development studies by USS Engineers and Consultants, Inc., Wisconsin Tech Search, request date Oct. 5, 2011, 17 pages.
Crelling, et al., "Effects of Weathered Coal on Coking Properties and Coke Quality", Fuel, 1979, vol. 58, Issue 7, pp. 542-546.
Database WPI, Week 199115, Thomson Scientific, Lond, GB; AN 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.
International Search Report and Written Opinion of International Application No. PCT/US2012/072174; dated Sep. 27, 2013; 12 pages.
JP 03-197588, Inoqu Keizo et al., Method and Equipment for Boring Degassing Hole in Coal Charge in Coke Oven, Japanese Patent (Abstract Only) Aug. 28, 1991.
JP 04-159392, Inoue Keizo et al., Method and Equipment for Opening Hole for Degassing of Coal Charge in Coke Oven, Japanese Patent (Abstract Only) Jun. 2, 1992.
Rose, Harold J., "The Selection of Coals for the Manufacture of Coke," American Institute of Mining and Metallurgical Engineers, Feb. 1926, 8 pages.
U.S. Appl. No. 15/392,942, filed Dec. 28, 2016, Quanci et al.
U.S. Appl. No. 15/322,176, filed Dec. 27, 2016, West et al.
U.S. Appl. No. 15/443,246, filed Feb. 27, 2017, Quanci et al.
U.S. Appl. No. 15/511,036, filed Mar. 14, 2017, West et al.
Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
U.S. Appl. No. 14/952,267, filed Nov. 25, 2015, Quanci et al.
U.S. Appl. No. 14/959,450, filed Dec. 4, 2015, Quanci et al.
U.S. Appl. No. 14/983,837, filed Dec. 30, 2015, Quanci et al.
U.S. Appl. No. 14/984,489, filed Dec. 30, 2015, Quanci et al.
U.S. Appl. No. 14/986,281, filed Dec. 31, 2015, Quanci et al.
U.S. Appl. No. 14/987,625, filed Jan. 4, 2016, Quanci et al.
U.S. Appl. No. 15/014,547, filed Feb. 3, 2016, Choi et al.
Basset, et al., "Calculation of steady flow pressure loss coefficients for pipe junctions," Proc Instn Mech Engrs., vol. 215, Part C. IMechIE 2001.
Costa, et al., "Edge Effects on the Flow Characteristics in a 90 deg Tee Junction," Transactions of the ASME, Nov. 2006, vol. 128, pp. 1204-1217.
U.S. Appl. No. 15/139,568, filed Apr. 27, 2016, Quanci et al.
Waddell, et al., "Heat-Recovery Cokemaking Presentation," Jan. 1999, pp. 1-25.
Westbrook, "Heat-Recovery Cokemaking at Sun Coke," AISE Steel Technology, Pittsburg, PA, vol. 76, No. 1, Jan. 1999, pp. 25-28.
Yu et al., "Coke Oven Production Technology," Lianoning Science and Technology Press, first edition, Apr. 2014, pp. 356-358.
"Resources and Utilization of Coking Coal in China," Mingxin Shen ed., Chemical Industry Press, first edition, Jan. 2007, pp. 242-243, 247.
U.S. Appl. No. 15/614,525, filed Jun. 5, 2017, Quanci et al.
"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.
Practical Technical Manual of Refractories, Baoyu Hu, etc., Bejing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
"Middletown Coke Company HRSG Maintenance BACT Analysis Option 1—Individual Spray Quenches Sun Heat Recovery Coke Facility Process Flow Diagram Middletown Coke Company 100 Oven Case #1-24.5 VM", (Sep. 1, 2009), URL: http://web.archive.org/web/20090901042738/http://epa.ohio.gov/portals/27/transfer/ptiApplication/mcc/new/262504.pdf, (Feb. 12, 2016), XP055249803 [X] 1-13 * p. 7 * *pp. 8-11 *.
Walker D N et al, "Sun Coke Company's heat recovery cokemaking technology high coke quality and low environmental impact", Revue De Metallurgie—Cahiers D'Informations Techniques, Revue De Metallurgie. Paris, FR, (Mar. 1, 2003), vol. 100, No. 3, ISSN 0035-1563, p. 23.
Bloom, et al., "Modular cast block—The future of coke oven repairs," Iron & Steel Technol, AIST, Warrendale, PA, vol. 4, No. 3, Mar. 1, 2007, pp. 61-64.
U.S. Appl. No. 16/251,352, filed Jan. 18, 2019, Quanci et al.
U.S. Appl. No. 16/000,516, filed Jun. 5, 2018, Quanci.
U.S. Appl. No. 16/026,363, filed Jul. 3, 2018, Chun et al.
U.S. Appl. No. 16/047,198, filed Jul. 27, 2018, Quanci et al.
Astrom, et al., "Feedback Systems: An Introduction for Scientists and Engineers," Sep. 16, 2006, available on line at http://people/duke.edu/-hpgavin/SystemID/References/Astrom-Feedback-2006.pdf ; 404 pages.
Boyes, Walt. (2003), Instrumentation Reference Book (3rd Edition)—34.7.4.6 Infrared and Thermal Cameras, Elsevier. Online version

(56) References Cited

OTHER PUBLICATIONS available at: https://app.knovel.com/hotlink/pdf/id:kt004QMGV6/instrumentation-reference-2/ditigal-video.
Industrial Furnace Design Handbook, Editor-in-Chief: First Design Institute of First Ministry of Machinery Industry, Beijing: Mechanical Industry Press, pp. 180-183, Oct. 1981.
Kerlin, Thomas (1999), Practical Thermocouple Thermometry—1.1 The Thermocouple. ISA. Online version available at https:app.knovel.com/pdf/id:kt007XPTM3/practical-thermocouple/the-thermocouple.
Madias, et al., "A review on stamped charging of coals" (2013). Available at https://www.researchgate.net/publication/263887759_A_review_on_stamped_charging_of_coals.
Metallurgical Coke MSDS, ArcelorMittal, May 30, 2011, available online at http://dofasco.arcelormittal.com/-/media/Files/A/Arcelormittal-Canada/material-safety/metallurgical-coke.pdf.
"What is dead-band control," forum post by user "wireaddict" on AllAboutCircuits.com message board, Feb. 8, 2007, accessed Oct. 24, 2018 at https:/forum.allaboutcircuits.com/threads/what-is-dead-band-contro1.4728/; 8 pages.
U.S. Appl. No. 14/655,003, filed Jun. 23, 2015, titled Systems and Methods for Maintaining a Hot Car in a Coke Plant.
U.S. Appl. No. 07/587,742, filed Sep. 25, 1990, now U.S. Pat. No. 5,114,542, titled Nonrecovery Coke Oven Battery and Method of Operation.
U.S. Appl. No. 07/878,904, filed May 6, 1992, now U.S. Pat. No. 5,318,671, titled Method of Operation of Nonrecovery Coke Oven Battery.
U.S. Appl. No. 09/783,195, filed Feb. 14, 2001, now U.S. Pat. No. 6,596,128, titled Coke Oven Flue Gas Sharing.
U.S. Appl. No. 07/886,804, filed May 22, 1992, now U.S. Pat. No. 5,228,955, titled High Strength Coke Oven Wall Having Gas Flues Therein.
U.S. Appl. No. 08/059,673, filed May 12, 1993, now U.S. Pat. No. 5,447,606, titled Method of and Apparatus for Capturing Coke Oven Charging Emissions.
U.S. Appl. No. 08/914,140, filed Aug. 19, 1997, now U.S. Pat. No. 5,928,476, titled Nonrecovery Coke Oven Door.
U.S. Appl. No. 09/680,187, filed Oct. 5, 2000, now U.S. Pat. No. 6,290,494, titled Method and Apparatus for Coal Coking.
U.S. Appl. No. 10/933,866, filed Sep. 3, 2004, now U.S. Pat. No. 7,331,298, titled Coke Oven Rotary Wedge Door Latch.
U.S. Appl. No. 11/424,566, filed Jun. 16, 2006, now U.S. Pat. No. 7,497,930, titled Method and Apparatus for Compacting Coal for a Coal Coking Process.
U.S. Appl. No. 12/405,269, filed Mar. 17, 2009, now U.S. Pat. No. 7,998,316, titled Flat Push Coke Wet Quenching Apparatus and Process.
U.S. Appl. No. 13/205,960, filed Aug. 9, 2011, now U.S. Pat. No. 9,321,965, titled Flat Push Coke Wet Quenching Apparatus and Process.
U.S. Appl. No. 11/367,236, filed Mar. 3, 2006, now U.S. Pat. No. 8,152,970, titled Method and Apparatus For Producing Coke.
U.S. Appl. No. 12/403,391, filed Mar. 13, 2009, now U.S. Pat. No. 8,172,930, titled Cleanable in Situ Spark Arrestor.
U.S. Appl. No. 12/849,192, filed Aug. 3, 2010, now U.S. Pat. No. 9,200,225, titled Method and Apparatus for Compacting Coal for a Coal Coking Process.
U.S. Appl. No. 13/631,215, filed Sep. 28, 2012, now U.S. Pat. No. 9,683,740, titled Methods for Handling Coal Processing Emissions and Associated Systems and Devices.
U.S. Appl. No. 13/730,692, filed Dec. 28, 2012, now U.S. Pat. No. 9,193,913, titled Reduced Output Rate Coke Oven Operation With Gas Sharing Providing Extended Process Cycle.
U.S. Appl. No. 14/921,723, filed Oct. 23, 2015, titled Reduced Output Rate Coke Oven Operation With Gas Sharing Providing Extended Process Cycle.
U.S. Appl. No. 14/655,204, filed Jun. 24, 2015, titled Systems and Methods for Removing Mercury From Emissions.
U.S. Appl. No. 16/000,516, filed Jun. 5, 2018, titled Systems and Methods for Removing Mercury From Emissions.
U.S. Appl. No. 13/830,971, filed Mar. 14, 2013, now U.S. Pat. No. 10,047,296, titled Non-Perpendicular Connections Between Coke Oven Uptakes and a Hot Common Tunnel, and Associated Systems and Methods, now U.S. Pat. No. 10,047,295.
U.S. Appl. No. 16/026,363, filed Jul. 3, 2018, titled Non-Perpendicular Connections Between Coke Oven Uptakes and a Hot Common Tunnel, and Associated Systems and Methods.
U.S. Appl. No. 13/730,796, filed Dec. 28, 2012, titled Methods and Systems for Improved Coke Quenching.
U.S. Appl. No. 13/730,598, filed Dec. 28, 2012, now U.S. Pat. No. 9,238,778, titled Systems and Methods for Improving Quenched Coke Recovery.
U.S. Appl. No. 14/952,267, filed Nov. 25, 2015, now U.S. Pat. No. 9,862,888, titled Systems and Methods for Improving Quenched Coke Recovery.
U.S. Appl. No. 15/830,320, filed Dec. 4, 2017, now U.S. Pat. No. 10,323,192, titled Systems and Methods for Improving Quenched Coke Recovery.
U.S. Appl. No. 13/730,735, filed Dec. 28, 2012, now U.S. Pat. No. 9,273,249, titled Systems and Methods For Controlling Air Distribution in a Coke Oven.
U.S. Appl. No. 14/655,013, filed Jun. 23, 2015, titled Vent Stack Lids and Associated Systems and Methods.
U.S. Appl. No. 13/843,166, now U.S. Pat. No. 9,273,250, filed Mar. 15, 2013, titled Methods and Systems for Improved Quench Tower Design.
U.S. Appl. No. 15/014,547, filed Feb. 3, 2016, titled Methods and Systems for Improved Quench Tower Design.
U.S. Appl. No. 13/829,588, now U.S. Pat. No. 9,193,915, filed Mar. 14, 2013, titled Horizontal Heat Recovery Coke Ovens Having Monolith Crowns.
U.S. Appl. No. 15/322,176, filed Dec. 27, 2016, now U.S. Pat. No. 10,526,541, titled Horizontal Heat Recovery Coke Ovens Having Monolith Crowns.
U.S. Appl. No. 15/511,036, filed Mar. 14, 2017, titled Coke Ovens Having Monolith Component Construction.
U.S. Appl. No. 16/704,689, filed Dec. 5, 2019, titled Horizontal Heat Recovery Coke Ovens Having Monolith Crowns.
U.S. Appl. No. 13/589,009, filed Aug. 17, 2012, titled Automatic Draft Control System for Coke Plants.
U.S. Appl. No. 15/139,568, filed Apr. 27, 2016, titled Automatic Draft Control System for Coke Plants.
U.S. Appl. No. 13/588,996, now U.S. Pat. No. 9,243,186, filed Aug. 17, 2012, titled Coke Plant Including Exhaust Gas Sharing.
U.S. Appl. No. 14/959,450, filed Dec. 4, 2015, now U.S. Pat. No. 10,041,002, titled Coke Plant Including Exhaust Gas Sharing, now U.S. Pat. No. 10,041,002.
U.S. Appl. No. 16/047,198, filed Jul. 27, 2018, titled Coke Plant Including Exhaust Gas Sharing.
U.S. Appl. No. 13/589,004, now U.S. Pat. No. 9,249,357, filed Aug. 17, 2012, titled Method and Apparatus for Volatile Matter Sharing in Stamp-Charged Coke Ovens.
U.S. Appl. No. 13/730,673, filed Dec. 28, 2012, titled Exhaust Flow Modifier, Duct Intersection Incorporating the Same, and Methods Therefor.
U.S. Appl. No. 15/281,891, filed Sep. 30, 2016, titled Exhaust Flow Modifier, Duck Intersection Incorporating the Same, and Methods Therefor.
U.S. Appl. No. 13/598,394, now U.S. Pat. No. 9,169,439, filed Aug. 29, 2012, titled Method and Apparatus for Testing Coal Coking Properties.
U.S. Appl. No. 14/865,581, filed Sep. 25, 2015, now U.S. Pat. No. 10,053,627, titled Method and Apparatus for Testing Coal Coking Properties, now U.S. Pat. No. 10,053,627.
U.S. Appl. No. 14/839,384, filed Aug. 28, 2015, titled Coke Oven Charging System.
U.S. Appl. No. 15/443,246, now U.S. Pat. No. 9,976,089, filed Feb. 27, 2017, titled Coke Oven Charging System.
U.S. Appl. No. 14/587,670, filed Dec. 31, 2014, titled Methods for Decarbonizing Coking Ovens, and Associated Systems and Devices.

(56) References Cited

OTHER PUBLICATIONS

U.S. Appl. No. 14/984,489, filed Dec. 30, 2015, titled Multi-Modal Beds of Coking Material.
U.S. Appl. No. 14/983,837, filed Dec. 30, 2015, titled Multi-Modal Beds of Coking Material.
U.S. Appl. No. 14/986,281, filed Dec. 31, 2015, titled Multi-Modal Beds of Coking Material.
U.S. Appl. No. 14/987,625, filed Jan. 4, 2016, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 16/428,014, filed May 31, 2019, titled Improved Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, now U.S. Pat. No. 10,526,542, titled Method and System for Dynamically Charging a Coke Oven.
U.S. Appl. No. 16/735,103, filed Jan. 6, 2020, titled Method and System for Dynamically Charging a Coke Oven.
U.S. Appl. No. 15/614,525, filed Jun. 5, 2017, titled Methods and Systems for Automatically Generating a Remedial Action in an Industrial Facility.
U.S. Appl. No. 15/987,860, filed May 23, 2018, titled System and Method for Repairing a Coke Oven.
U.S. Appl. No. 16/729,053, filed Dec. 27, 2019, titled Oven Uptakes.
U.S. Appl. No. 16/729,036, filed Dec. 27, 2019, titled Systems and Methods for Treating a Surface of a Coke Plant.
U.S. Appl. No. 16/729,201, filed Dec. 27, 2019, titled Gaseous Tracer Leak Detection.
U.S. Appl. No. 16/729,122, filed Dec. 27, 2019, titled Methods and Systems for Providing Corrosion Resistant Surfaces in Contaminant Treatment Systems.
U.S. Appl. No. 16/729,068, filed Dec. 27, 2019, titled Systems and Methods for Utilizing Flue Gas.
U.S. Appl. No. 16/729,129, filed Dec. 27, 2019, titled Coke Plant Tunnel Repair and Flexible Joints.
U.S. Appl. No. 16/729,170, filed Dec. 27, 2019, titled Coke Plant Tunnel Repair and Anchor Distribution.
U.S. Appl. No. 16/729,157, filed Dec. 27, 2019, titled Particulate Detection for Industrial Facilities, and Associated Systems and Methods.
U.S. Appl. No. 16/729,057, filed Dec. 27, 2019, titled Decarbonization of Coke Ovens and Associated Systems and Methods.
U.S. Appl. No. 16/729,212, filed Dec. 27, 2019, titled Heat Recovery Oven Foundation.
U.S. Appl. No. 16/729,219, filed Dec. 27, 2019, titled Spring-Loaded Heat Recovery Oven System and Method.
U.S. Appl. No. 16/428,014, filed May 31, 2019, Quanci et al.
U.S. Appl. No. 16/704,689, filed Dec. 5, 2019, West et al.
U.S. Appl. No. 16/729,036, filed Dec. 27, 2019, Quanci et at.
U.S. Appl. No. 16/729,053, filed Dec. 27, 2019, Quanci et at.
U.S. Appl. No. 16/729,057, filed Dec. 27, 2019, Quanci et at.
U.S. Appl. No. 16/729,068, filed Dec. 27, 2019, Quanci et at.
U.S. Appl. No. 16/729,122, filed Dec. 27, 2019, Quanci et at.
U.S. Appl. No. 16/729,129, filed Dec. 27, 2019, Quanci et at.
U.S. Appl. No. 16/729,157, filed Dec. 27, 2019, Quanci et at.
U.S. Appl. No. 16/729,170, filed Dec. 27, 2019, Quanci et at.
U.S. Appl. No. 16/729,201, filed Dec. 27, 2019, Quanci et at.
U.S. Appl. No. 16/729,212, filed Dec. 27, 2019, Quanci et at.
U.S. Appl. No. 16/729,219, filed Dec. 27, 2019, Quanci et at.
U.S. Appl. No. 16/735,103, filed Jan. 6, 2020, Quanci et al.
Joseph, B., "A tutorial on inferential control and its applications," Proceedings of the 1999 American Control Conference (Cat. No. 99CH36251), San Diego, CA, 1999, pp. 3106-3118 vol. 5.
Knoerzer et al. "Jewell-Thompson Non-Recovery Cokemaking", Steel Times, Fuel & Metallurgical Journals Ltd. London, GB, vol. 221, No. 4, Apr. 1, 1993, pp. 172-173,184.
Brazilian Examination Report for Brazilian Application No. BR102013000284-4, dated Mar. 12, 2019; 6 pages.

* cited by examiner

SYSTEMS AND METHODS FOR MAINTAINING A HOT CAR IN A COKE PLANT

TECHNICAL FIELD

The present technology is generally directed to systems and methods for maintaining a flat push hot car in a coke plant. More specifically, some embodiments are directed to systems and methods for cooling a hot box portion of a flat push hot car.

BACKGROUND

Coke is a solid carbon fuel and carbon source used to melt and reduce iron ore in the production of steel. To make coke, finely crushed coal is fed into a coke oven and heated in an oxygen depleted environment under closely controlled atmospheric conditions. Such an environment drives off volatile compounds in the coal, leaving behind coke. In some coking plants, once the coal is "coked out" or fully coked, an oven door is opened and the hot coke is pushed from the oven into a hot box of a flat push hot car ("hot car"). The hot car then transports the hot coke from the coke oven to a quenching area (e.g., wet or dry quenching) to cool the coke below its ignition temperature. After being quenched, the coke is screened and loaded into rail cars or trucks for shipment or later use.

Over time, the volatile coal constituents (i.e., water, coal-gas, coal-tar, etc.) released during the coking process can accumulate on the interior surfaces of the coke oven, forming gummy, solidified by-product deposits. As used herein, "deposit(s)" refers to one or more coking by-products that can accumulate within the coke oven, such as, for example, clinkers, ash, and others. Such deposits can have a variety of adverse effects on coke production, including slowing and/or complicating the hot coke pushing operation, decreasing the effective dimensions of the oven, and lowering the thermal conductivity of the oven walls and/or floor. Because of such adverse effects, deposit removal ("decarbonization") is a mandatory aspect of routine coke oven maintenance in order to maintain coke plant efficiency and yield.

To remove deposits from the coke ovens, oven operation (and thus coke production) must be interrupted so that the deposits can be targeted and pushed out of the ovens and into the hot car hot box for disposal. Much like the hot coke, deposits are extremely hot and exert a large amount of thermal and mechanical stress on the hot box in addition to the wear and tear of routine hot coke transportation. For these reasons, the hot box and/or the hot box's individual components can have a relatively short life. Many conventional coke plants attempt to mitigate damage to the hot box by breaking up large deposits and transporting them to a quench tower for cooling in manageable, smaller portions. However, such an iterative approach takes a long time to remove the waste, thus keeping the ovens/quench tower out of operation and coke production at a halt. In addition, removing the waste in pieces increases the number of transports required of the hot cars, exposing hot cars and/or its individual components to increased amount of thermal and mechanical stress.

DETAILED DESCRIPTION

The present technology describes various embodiments of systems and methods for maintaining a flat push hot car. In some embodiments, the flat push hot car includes an at least partially enclosed hot box having an interior portion, an exterior portion, a base, and a plurality of sidewalls extending upward from the base. The hot box can be coupled to or integrated with a fluid distribution system. The fluid distribution system can include a spray manifold having one or more inlets configured to release a fluid directed toward the sidewalls of the interior portion so as to provide regional cooling to the hot box.

Specific details of several embodiments of the technology are described below with reference to FIGS. 1-6C. Other details describing well-known structures and systems often associated with coal processing and/or cooling systems have not been set forth in the following disclosure to avoid unnecessarily obscuring the description of the various embodiments of the technology. Many of the details, dimensions, angles and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-6C.

Figure 1:
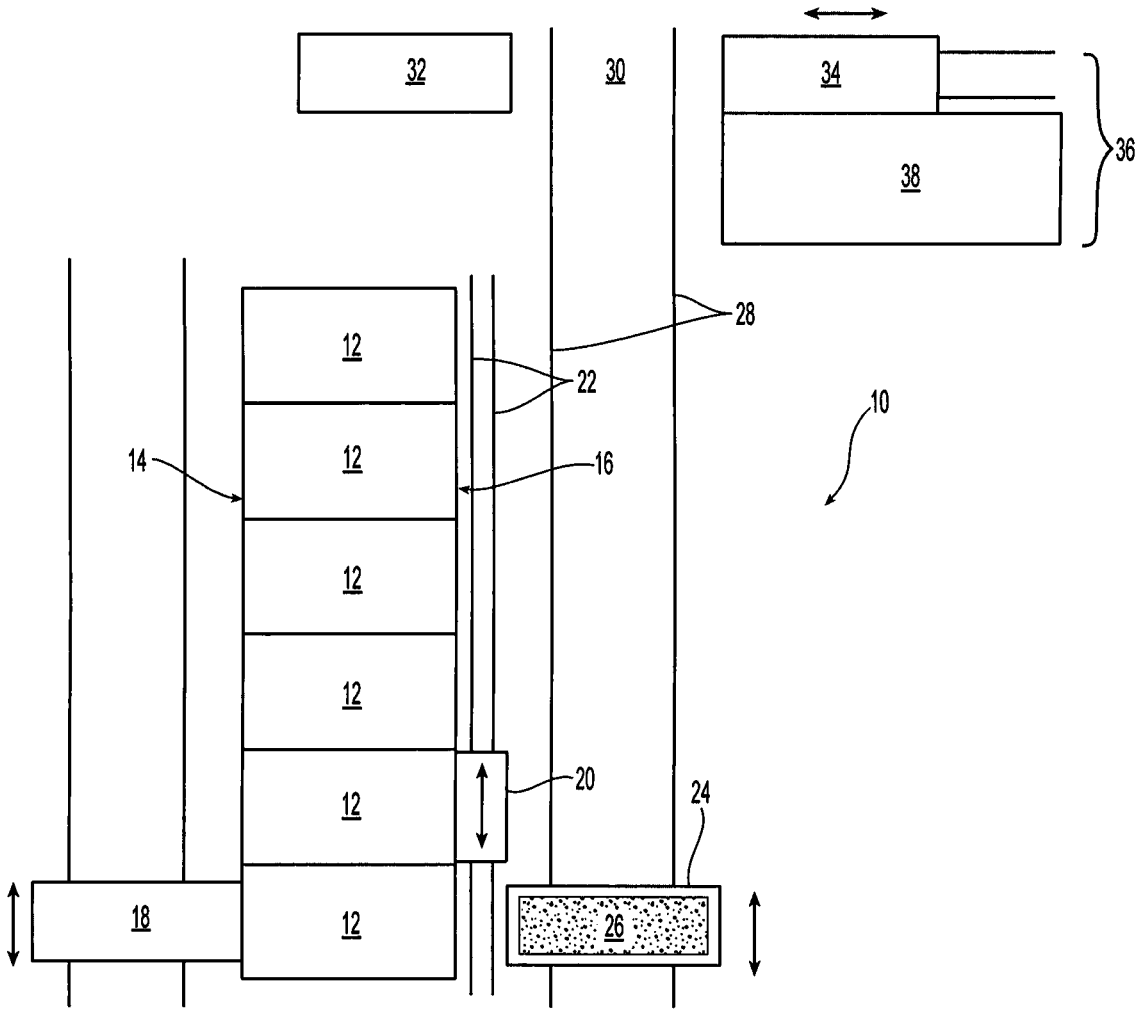
FIG. 1 is a plan view of a portion of a coke plant in accordance with embodiments of the present technology.
Figure 2:
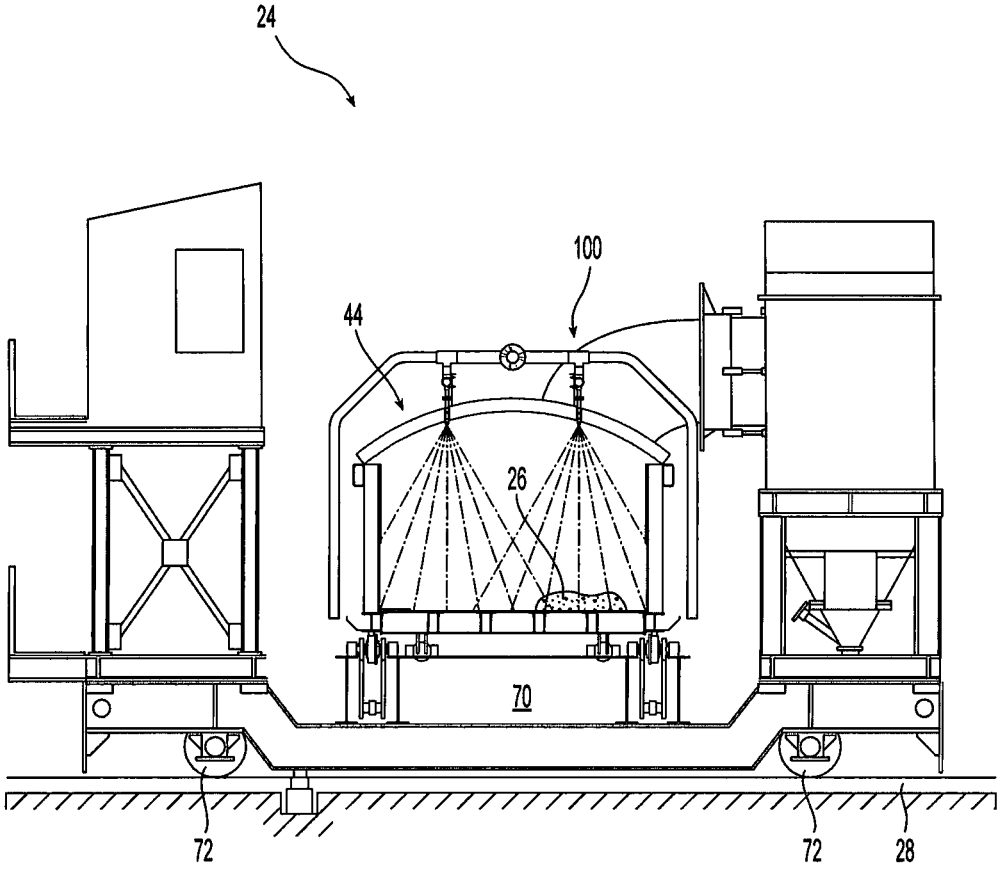
FIG. 2 is an elevational end view of a flat push hot car in accordance with embodiments of the present technology.

FIG. 1 is a plan schematic view of a coke oven battery 10 and associated equipment, including a hot car 24, according to embodiments of the technology. As used herein, "hot car" may comprise a flat push hot car, train, and/or a combined flat push hot car/quench car. The typical coke oven battery 10 contains a plurality of side-by-side coke ovens 12. Each of the coke ovens 12 has a coal inlet end 14 and a coke outlet end 16 opposite the inlet end 14. Once the coal is fully coked (typically 24-120 hours), an exit door removing device 20 is positioned adjacent the outlet end 16 of the oven 12 and removes an exit door of the oven 12. After removing the exit door, the door removing device 20 is moved away from the outlet end 16 of the oven 12 along door removal rails 22. A discharge ram 18 positioned adjacent to the inlet end 14 of the oven 12 pushes the hot coke and/or deposits out of the oven 12. The discharge ram 18 may include a device for removing an inlet end 14 oven door prior to pushing the coke out of the oven 12. A hot car 24 (described in greater detail below) is positioned adjacent to the outlet end 16 of the oven 12 for collection of hot coke and/or deposits 26 pushed from the oven by the discharge ram 18. Once the hot coke or deposits 26 is loaded onto the hot car 24, the car 24 is transported on rails 28 to a quench car area 30. In the quench car area 30, the hot coke slab or deposits 26 on the hot car 24 is pushed by a stationary pusher 32 onto a quench car 34. Once the quench car 34 receives the hot coke or deposits 26, the quench car 34 is positioned in a quench station 36 wherein the hot coke or deposits 26 is quenched with sufficient water to cool the coke or deposits 26 to below a coking temperature. The quenched coke is then dumped onto a receiving dock 38 for further cooling and transport to a coke storage area.

In some embodiments described herein, a single hot car 24 may be used for multiple coke batteries 10 since the coke is quenched in a separate quench car 34. As soon as the hot coke or deposits 26 is pushed from the hot car 24 onto the quench car 34, the hot car 24 may be repositioned adjacent to the outlet end 16 of another oven 12 for collection of coke or deposits 26 from that oven 12. In further embodiments, the hot car 24 can be a combined hot car/quench car.

With reference now to FIGS. 2-6C, various aspects of the hot car 24 will be illustrated and described. As shown in the elevated cross-sectional end view of FIG. 2, the hot car 24 can include a hot box 44 configured to receive hot coke and/or deposits 26. The hot car 24 can further include a hot box fluid distribution system 100 coupled to the hot box 44. As explained below, the fluid distribution system 100 provides efficient cooling processes to the hot box 44 to extend its useful life and/or the useful life of the individual components of the hot box 44. The hot car 24 is mounted on a frame 70 that contains wheels 72 for movement of the hot car 24 on the rails 28 to and from the ovens 12 to the quench station 36 (the ovens 12 and quench station 36 are shown in FIG. 1).

Figure 3A:
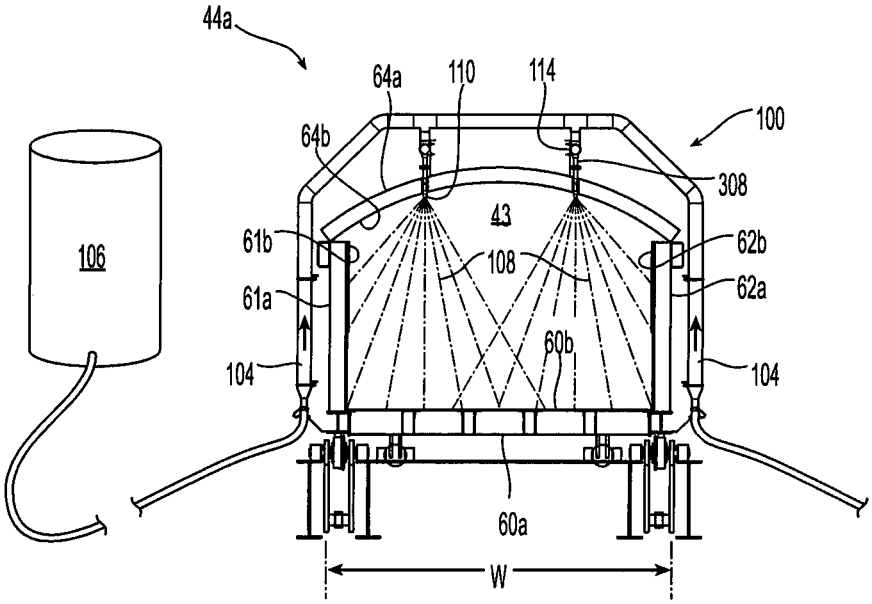
FIG. 3A is an elevational end view of a hot box in accordance with embodiments of the present technology.
Figure 3B:
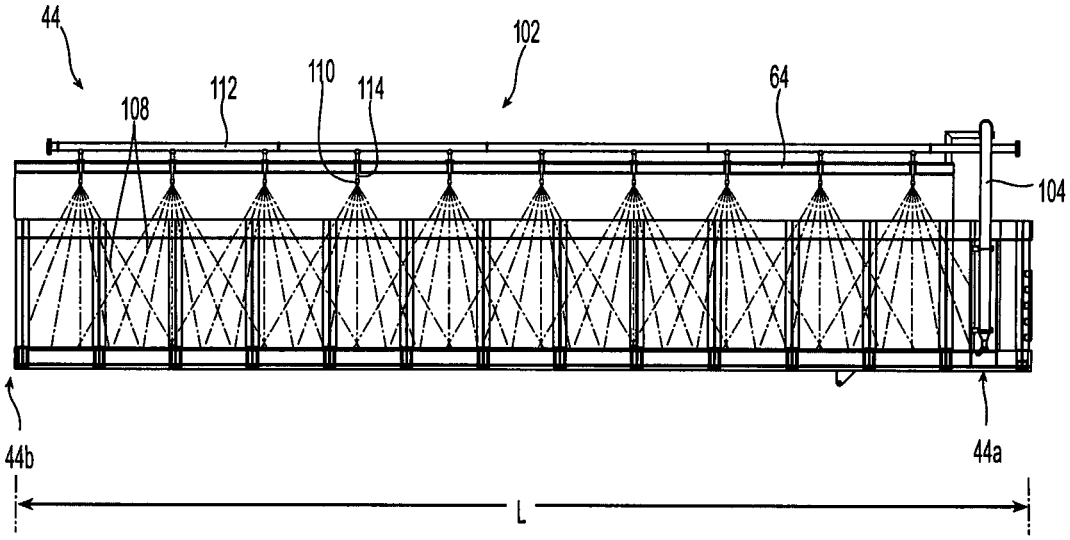
FIG. 3B is a side view of a hot box in accordance with embodiments of the present technology.

FIGS. 3A and 3B show the hot box 44 configured in accordance with embodiments of the present technology. The hot box 44 is a substantially rectangular housing having a floor 60, two sidewalls 61, 62 and a ceiling 64, together defining an interior portion 43 therein. The hot box 44 can have a width W defined between the first sidewall 61 and the second sidewall 62 and a hot box length L defined between a first end 44*a* and a second end 44*b*. Each end 44*a*, 44*b* of the hot box can open to facilitate the hot box 44 in receiving or removing hot coke and/or deposits 26. Each of the floor 60, sidewalls 61, 62 and ceiling 64 can have an exterior surface (60*a*, 61*a*, 62*a*, and 64*a*, respectively) and an interior surface (60*b*, 61*b*, 62*b*, and 64*b*, respectively) as shown in FIG. 3A. In various embodiments, the sidewalls 61, 62 and/or floor 60 can be solid or fully or partially permeable and/or have apertures and/or cooling pipes therein.

As described above, the hot box 44 can include a fluid distribution system 100 configured to contain, deliver, and/or distribute cooling fluid 108 to one or more interior and/or exterior surfaces of the hot box 44. The fluid distribution system 100 can include a fluid source 106, a supply pipe 104 and a spray manifold 102 in fluid communication with one another. The spray manifold 102 can include one or more inlet pipes 114. As used herein, the term "pipe(s)" may comprise one or more ducts, channels, conduits, tunnels, and/or any other structure and/or material capable of moving and/or guiding a fluid, gas or semi-solid. At its downstream end, the inlet pipe 114 can have an inlet 110. The inlet 110 can protrude into the interior portion 43, be flush with the ceiling 64, or be positioned above the ceiling 64 wherein the ceiling 64 has apertures to allow fluid flow therethrough. The inlet 110 can release fluid 108 into the interior portion 43 of the hot box 44, and, as will be described in further detail below, can comprise a single inlet 110 or an array of inlets. The inlet 110 can include a nozzle 116, including a flat fan nozzle, flood nozzle, raindrop nozzle, hollow-cone nozzle, full-cone nozzle, directional or bi-directional nozzle, and others. In yet other embodiments, the inlet 110 may be an opening in the inlet pipe 114 that routes fluid 108 from the spray manifold 102 to an interior portion 43 of the hot box 44 (as explained in greater detail below with reference to FIG. 5C).

Although the embodiments shown in FIGS. 2-6C illustrate a hot box having two sidewalls and a ceiling, in some embodiments, the hot box may have more or less than two sidewalls. In yet other embodiments, the hot box may not have a ceiling or have a ceiling that covers only a portion of the hot box floor. In some embodiments, the hot box may have no sidewalls and simply comprise a fluid distribution system mounted over a hotbox floor.

In operation, the fluid source 106 provides fluid 108 to the supply pipe 104 which in turn transfers the fluid 108 to the spray manifold 102 for release and/or distribute through the inlet(s) 110 onto at least a portion of the interior and/or exterior surfaces of the hot box 44. For example, the inlets 110 can release and/or distribute fluid 108 onto at least a portion of the interior surface of the sidewalls 61*b*, 62*b*, floor 60*b* and/or ceiling 64*b* of the hot box 44, providing regional zones of cooling to the hot box 44. Such regional cooling almost immediately reduces the average temperature of the hot box 44 and decreases thermal stresses. In some embodiments, the sidewalls 61, 62 and/or floor 60 can be solid or fully or partially permeable and/or have apertures and/or cooling pipes therein to release the cooling fluid 108 after it has interfaced with the interior surfaces of the hot box 44 or to provide fluid flow within the hot box 44. A "fluid" 108 may refer to any gas, liquid and/or semi-solid capable of lowering the average temperature of the hot box 44 or portion of the hot box 44 when applied to any portion of the hot box 44 and/or its contents. For example, in several embodiments, the fluid 108 can be water. In other embodiments, the fluid may include one or more chemicals able to extinguish or at least partially control a fire.

Figure 4A:
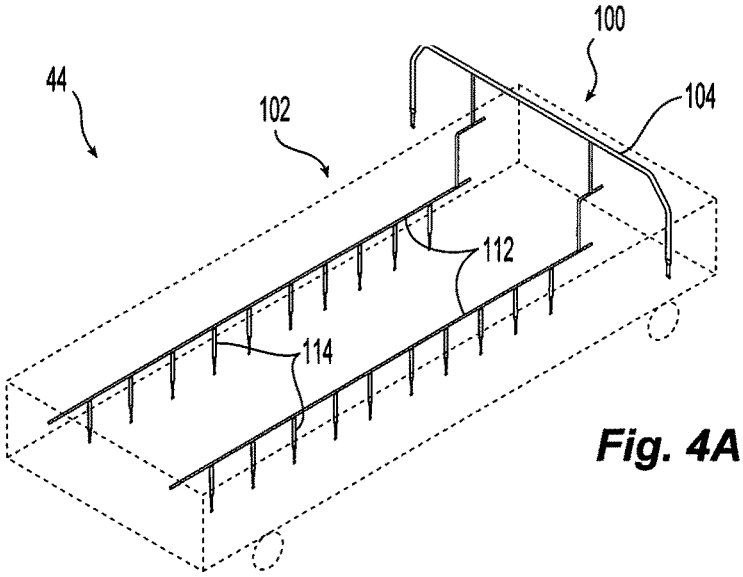
FIG. 4A is a perspective view of a fluid distribution system in accordance with embodiments of the present technology.
Figure 4B:
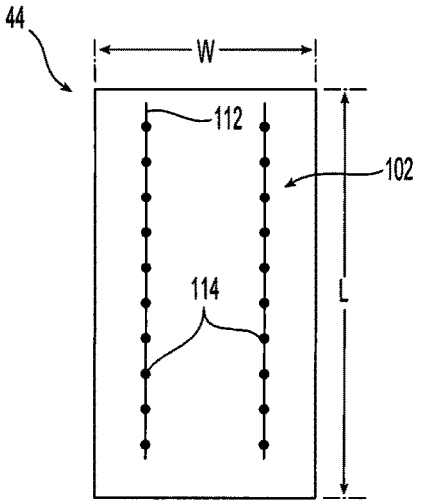
FIG. 4B is a simplified plan view of the fluid distribution system of FIG. 4A in accordance with embodiments of the present technology.
Figure 4C:
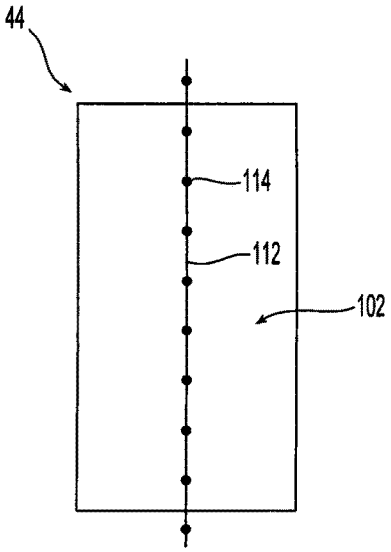
FIG. 4C is a simplified plan view of a fluid distribution system view in accordance with embodiments of the present technology.
Figure 4D:
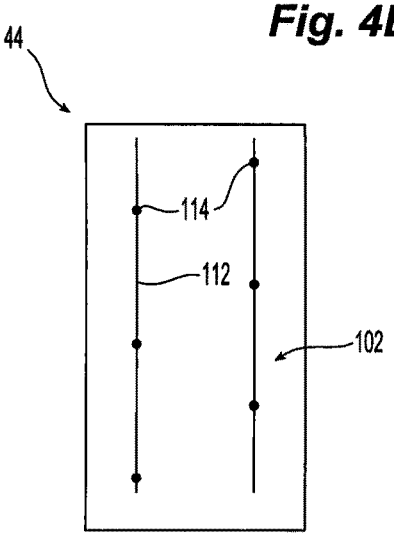
FIG. 4D is a simplified plan view of a fluid distribution system view in accordance with embodiments of the present technology.

FIGS. 4A and 4B illustrate a perspective view and plan view, respectively, of the spray manifold 102. The spray manifold 102 may include an inlet array having one or more inlets 110 configured about one or more rows 112 and/or crosspieces 113 (the crosspieces are shown and discussed below with reference to FIGS. 4F-4I). The rows 112 and/or crosspieces 113 can be coupled to the supply pipe 104 in order to direct the cooling fluid from the supply pipe 104 to the inlets 110 via the inlet pipes 114.

As used herein, an "inlet array" refers to the various configurations and/or placement of the inlets 110 with respect to the rest of the hot box structure. For example, FIG. 4B shows the inlets 110 may be spaced along one or more parallel rows 112. In other embodiments, as shown in the schematic plan views of FIGS. 4C-4J, the spray manifold 102 may comprise one or more of a variety of inlet arrays based on the desired fluid distribution pattern and/or targeted cooling regions. For example, in the embodiment shown in FIG. 4F, the inlets 110 and/or inlet pipes 114 may be arranged on the spray manifold 102 along a perimeter of the hot box 44 so as to direct a cooling fluid towards the interior surfaces of the sidewalls 61*b*, 62*b* and/or ends 44*a*, 44*b* of the hot box 44. During decarbonization, it is important to adequately cool the hot box sidewalls so as to preserve the integrity of the hot box 44 structure and/or materials.

Figure 4E:
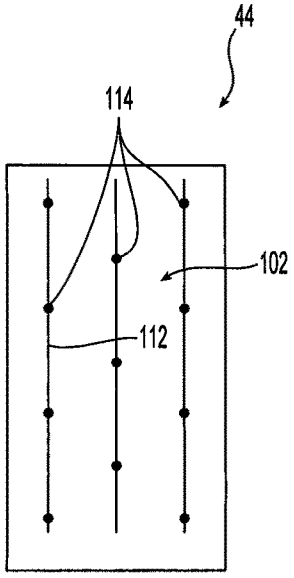
FIG. 4E is a simplified plan view of a fluid distribution system view in accordance with embodiments of the present technology.
Figure 4F:
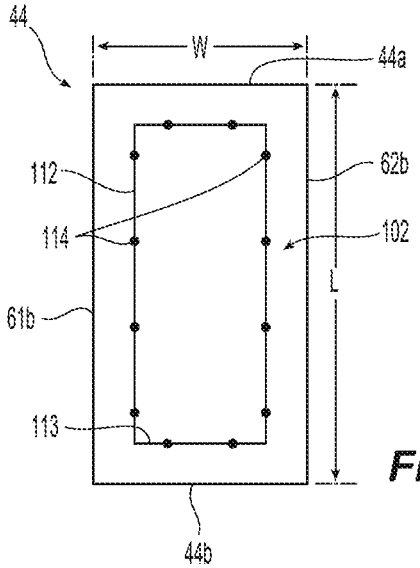
FIG. 4F is a simplified plan view of a fluid distribution system view in accordance with embodiments of the present technology.
Figure 4G:
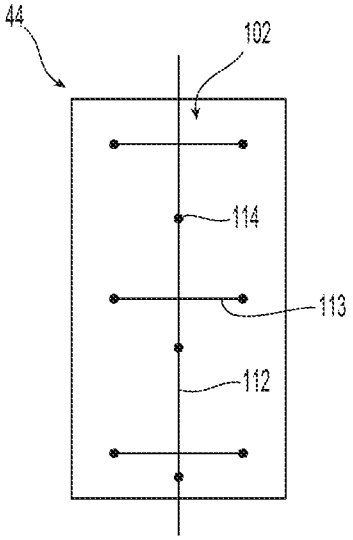
FIG. 4G is a simplified plan view of a fluid distribution system view in accordance with embodiments of the present technology.
Figure 4H:
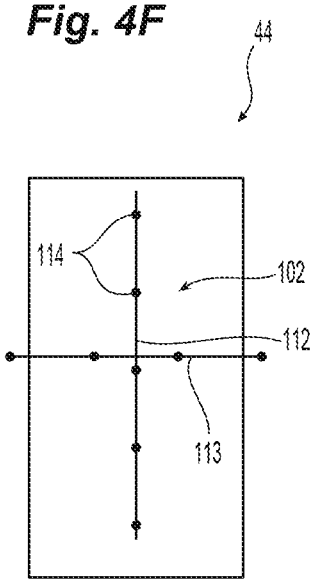
FIG. 4H is a simplified plan view of a fluid distribution system view in accordance with embodiments of the present technology.
Figure 4I:
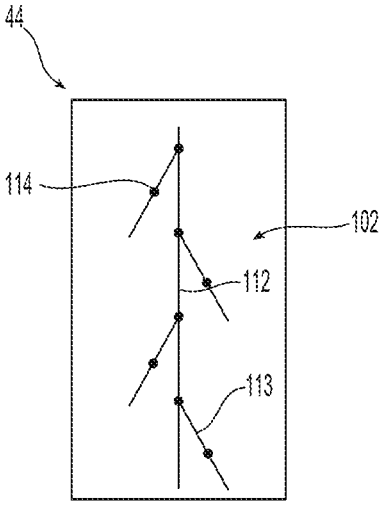
FIG. 4I is a simplified plan view of a fluid distribution system view in accordance with embodiments of the present technology.
Figure 4J:
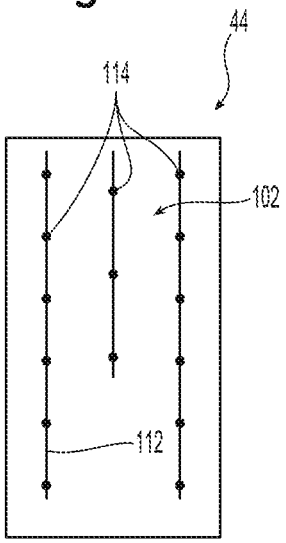
FIG. 4J is a simplified plan view of a fluid distribution system view in accordance with embodiments of the present technology.

The inlet pipes 114 and/or inlets 110 may have approximately the same or varied placement along one or more rows 112 and/or crosspieces 113. For example, in some embodiments the inlet pipes 114 and/or inlets 110 may be evenly spaced along the row 112 and/or crosspiece 113 (i.e., FIG. 4B), while in other embodiments the inlet pipes 114 and/or inlets 110 may be unevenly spaced. In some embodiments, the inlet pipes 114 and/or inlets 110 may have approximately the same placement along adjacent rows 112 and/or crosspieces 113 relative to a length L of the hot box 44 (FIG. 4B), and/or in other embodiments the inlet pipes 114 and/or inlets may be offset (FIG. 4E).

The rows 112 and crosspieces 113 (and inlet array) can have a variety of sizes and/or configurations. In some embodiments, the inlet array may span the length L of the hot box 44 or may be shorter (i.e., FIG. 4J) or longer than the hot box (i.e., FIG. 4C). In some embodiments, some or all of the inlet pipes and/or inlets may be positioned outside of the width and/or length of the hot box so as to direct a cooling fluid onto an exterior surface of the hot box sidewalls 61, 62, ceiling 64, and/or floor 60 (i.e., FIG. 4F). In some embodiments, adjacent rows 112 may have approximately the same (i.e., FIG. 4E) or different lengths (i.e., FIG. 4J) to provide symmetric or asymmetric cooling in the hot box 44. The crosspieces 113 may run transverse to the rows 112 (i.e., FIGS. 4G and 4H) or may extend at any angle from the rows 112 (i.e., FIG. 4I). The crosspieces 113 may span the width W of the hot box 44 or may be shorter (i.e., FIG. 4G) or longer than (for example, see FIG. 4H) the hot box 44.

Figure 5A:
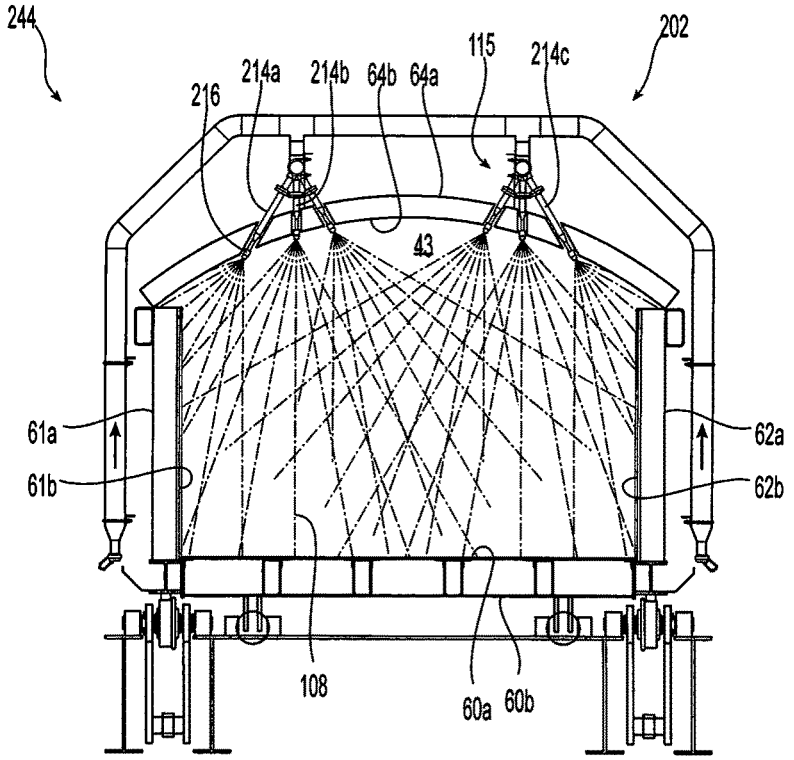
FIG. 5A is an elevational side view of a hot box and a fluid distribution system in accordance with embodiments of the present technology.

FIGS. 5A-5F illustrate several embodiments of fluid distributions systems providing regions of cooling in accordance with embodiments of the technology. In FIG. 5A, more than one inlet pipe 214 can branch from approximately the same portion of a spray manifold 202 to form a nozzle cluster 115. Likewise, the inlet pipes 214 and/or nozzles 216 associated with a nozzle cluster 115 may have varying directionality. For example, in FIG. 5A, inlet pipe 214*a* is angled towards sidewall 61, inlet pipe 214*b* extends substantially straight down, and inlet pipe 214*c* is angled towards sidewall 62.

Figure 5B:
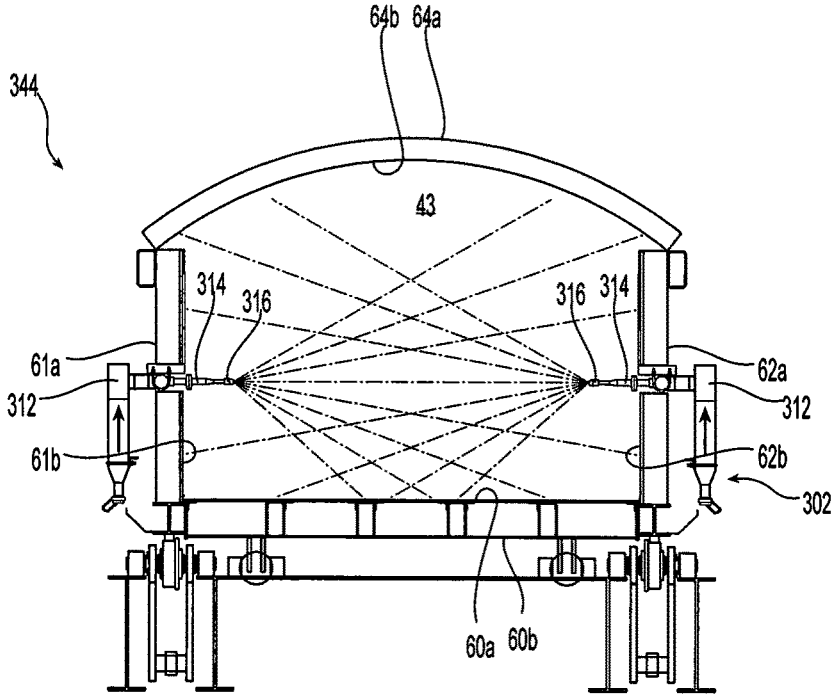
FIG. 5B is an elevational side view of a hot box and a fluid distribution system in accordance with embodiments of the present technology.

In some embodiments, as shown in FIG. 5A, the spray manifold 202 can be positioned along the hot box ceiling 64, or can be spaced apart from the hot box ceiling 64. In further embodiments, as shown in FIG. 5B, the spray manifold 302 can be positioned along one or more hot box sidewalls 61, 62. The spray manifold 302 may comprise rows 312 positioned proximate the sides 61, 62 of the hot box 344 with inlet pipes 314 coming through or positioned along the sidewalls 61, 62. In other embodiments, the rows can be proximate to the bottom 49 of the hot box (not shown). In still further embodiments, the inlet pipes can be positioned all or partially external to the hot box (e.g., to distribute fluid to an exterior surface of the hot box).

Figure 5C:
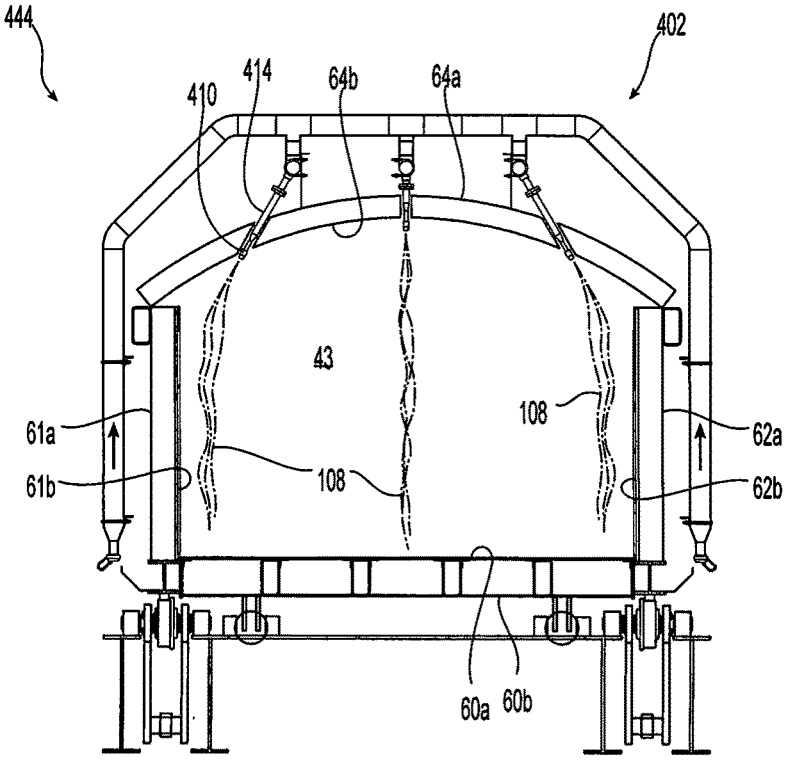
FIG. 5C is an elevational side view of a hot box and a fluid distribution system in accordance with embodiments of the present technology.
Figure 5D:
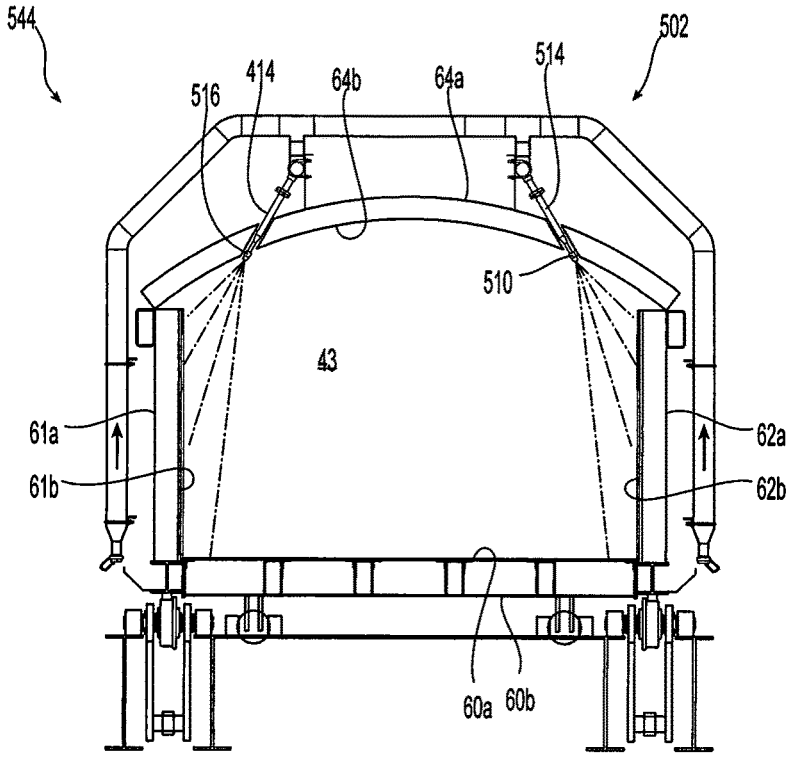
FIG. 5D is an elevational side view of a hot box and a fluid distribution system in accordance with embodiments of the present technology.

As shown in FIG. 5C, the inlets 410 can comprise an opening in the inlet pipe 414 and/or spray manifold 402 such that gravity pulls the fluid onto the hot box 444. In these embodiments, at least a portion of the fluid source (not shown) can be positioned vertically above the inlets 410 so as to create sufficient head pressure (as discussed below with reference to FIGS. 6A-6B). In some embodiments, as shown in FIG. 5D, the inlet pipes 514 may be angled as they extend downward from the intersection 515. In yet other embodiments, the inlet pipes 514 may extend substantially perpendicular to the hot box floor 60 (for example, see FIG. 3A, described above).

Figure 5E:
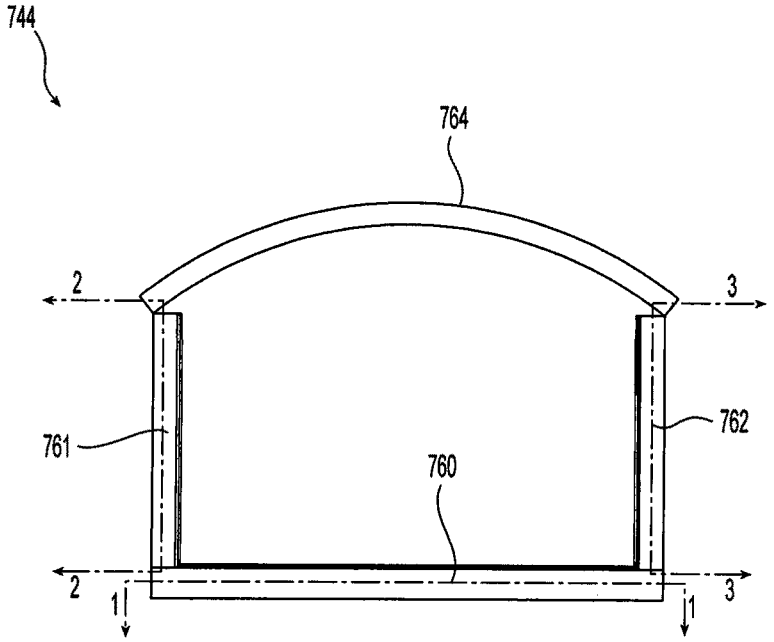
FIG. 5E is a schematic illustration of a hot box and a fluid distribution system in accordance with embodiments of the present technology.
Figure 5F:
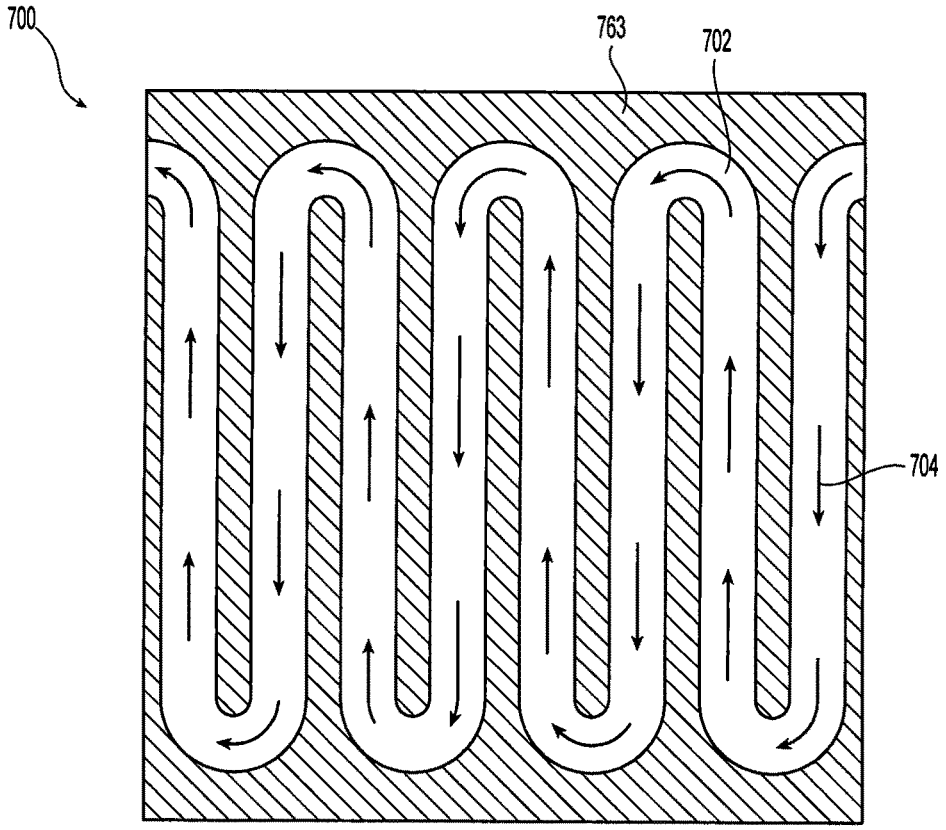
FIG. 5F is a schematic sectional view of the hot box of FIG. 5E taken along lines 1, 2, and 3.

FIGS. 5E and 5F show an embodiment in accordance with the present technology where a hot box 744 has a fluid distribution system 700 comprising pipes 702 within its sidewalls 761, 762, ceiling 764, and/or floor 760 (collectively represented in FIG. 5F by element 763). The pipes 702 carry a cooling fluid 704 and may comprise a serpentine configuration (as shown in the cross-sectional view of FIG. 5F) or may comprise any appropriate configuration to achieve one or more desired regions of cooling.

The fluid distribution system may have one or more valves located at any point within the system. For example, a valve may be located at the juncture between the fluid supply and the supply pipes. In other embodiments, valves may be located at each inlet. Control of the valves and/or release of the fluid may be triggered manually, on a pre-set schedule, automatically by a controller, or manually with an automatic override. Likewise, the fluid may be released from all inlets simultaneously and/or programmed preferentially to form a localized group of targeted cooling regions.

The controller can be a discrete controller associated with a single inlet or multiple automatic inlets, a centralized controller (e.g., a distributed control system or a programmable logic control system), or a combination of the two.

Accordingly, individual inlets and/or valves can be operated individually or in conjunction with other inlets or valves.

In some embodiments, the coke plant, hot car, hot box, and/or fluid distribution system may include a fluid collection system to redirect and/or retain fluid overflow from the hot box. In some embodiments, the fluid collection system may filter then recycle the overflow. In other embodiments, the fluid collection system may include a pump to facilitate reuse of the overflow. In yet other embodiments, at least a portion of the fluid collection system may be positioned below the base of the hot box such that fluid overthrow is forced through the fluid collection system, which filters the overflow before it hits the ground. In further embodiments, fluid overflow may be allowed to flow substantially unfiltered to the ground.

Figure 6A:
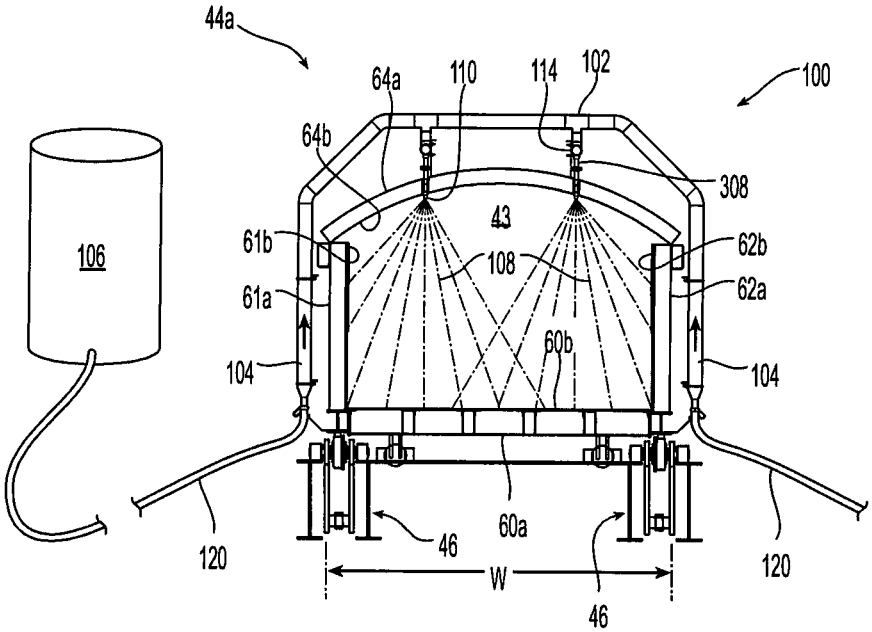
FIG. 6A is an elevational side view of a hot box and a fluid distribution system having a fluid source in accordance with embodiments of the present technology.

As shown in FIG. 6A, the fluid source 106 may comprise a local fluid reservoir 106 having a hose 120 in fluid connection with the supply pipe 104 which transfers the fluid 108 from the fluid source 106 to the spray manifold 102. The length of the hose 120 can be sufficient to remain coupled to the fluid distribution system 100 of the hot car 44 as the hot car 24 moves along the rails 28, or can be separable from the hot car 44.

Figure 6B:
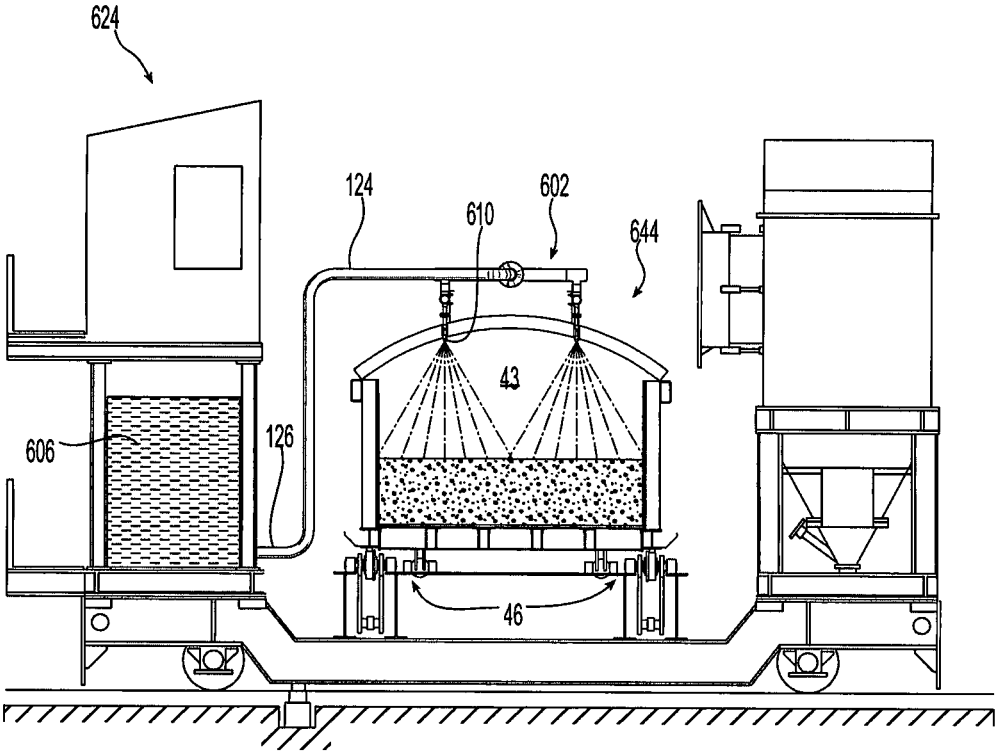
FIG. 6B is an elevational side view of a hot box and fluid source carried by a flat push hot car in accordance with embodiments of the present technology.
Figure 6C:
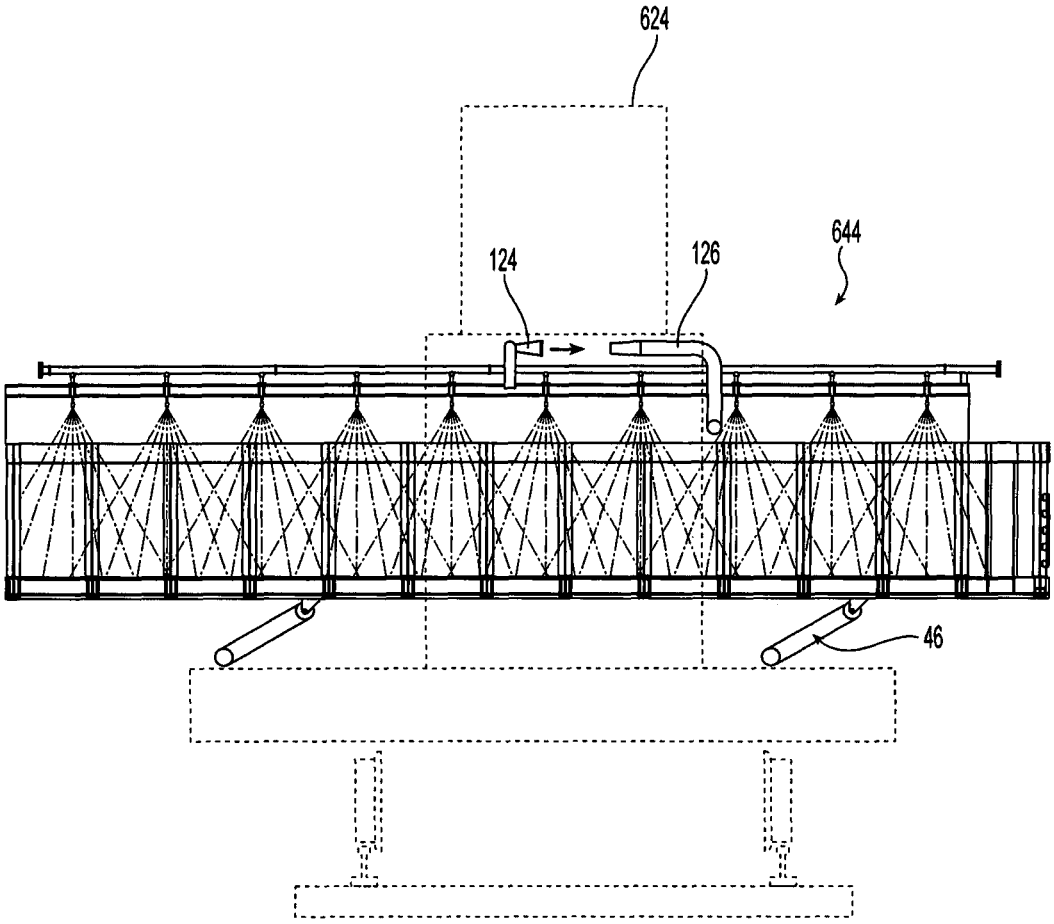
FIG. 6C is an elevational side view of the hot box and fluid source of FIG. 6B in accordance with embodiments of the present technology.

FIGS. 6B-6C illustrate embodiments wherein the fluid source comprises a pump or pressurized tank and/or reservoir 606 coupled to the hot car 24. In some embodiments, at least a portion of the fluid source can be positioned vertically above the inlets 610 so as to create sufficient head pressure. The hot box 644 includes a hot box connection 124 in fluid connection with the spray manifold 602. The connection 124 is configured to mate with a hot car connection 126. In operation, when an elevation and translation system 46 moves the hot box 44 back onto the flat push hot car 24 after being positioned adjacent to the oven 12, the hot box connection 124 mates with the flat push hot car connection 126 to effectively seal the system. Furthermore, in some embodiments, the reservoir 606 could be carried by the hot box 44. For example, the reservoir 606 may be located on top of a hot box ceiling or be coupled to a sidewall.

In some embodiments, the hot car may include several other features for interfacing with the coke oven, quench car, and/or other coke plant equipment. For example, the hot car may include an elevation and translation mechanism 46 (shown in FIG. 6B) configured to elevate and translate the hot box 44 so as to position the hot box 44 adjacent the outlet end 16 of the oven 12. The elevation and translation mechanism provides for a relatively smooth transition for the hot coke and/or deposits 26 to move from the oven floor to the hot box 44. The flat push hot car 24 may also include a dust collection system in flow communication with the hot box 44 via a collection duct to collect any dust or fumes that may be evolved from the coke during the coke pushing operations. In some embodiments, the flat push hot car 24 may further include a lintel sealing device that provides sealing between the hot box 44 and the oven 12 in order to reduce an amount of dust that may escape from the open end 16 of the oven 12. In yet other embodiments, an oven skirt sweeping mechanism may be provided on the transition section in order to prevent accumulation of coke dust on an oven sill attached to each oven 12 after removing the oven exit door 40 or after pushing the hot coke and/or deposits 26 onto the hot car 24.

In operation, the fluid distribution system 100 may be utilized during an emergency situation where the hot car 24 breaks down and is unable to complete transport of the hot coke and/or deposits to a quenching area. Not only does this stall coke production, but it also significantly delays cooling of the hot car, likely resulting in irreparable damage to the hot car 24 and/or hot box 44. If such a failure occurs, the fluid distribution system may be manually or automatically triggered and immediately begin cooling the hot box and/or its contents.

The fluid distribution system 100 may also be used during the decarbonization process. As explained above, decarbonization is a mandatory aspect of routine coke oven maintenance in order to maintain coke plant efficiency and yield. Because the fluid distribution system provides regional cooling of the hot box (thus lowering the average temperature of the hot box), the hot box is able to handle and thus transport larger deposits piles than it could without a cooling system. By transporting larger deposits piles, the flat push hot car can dispose of deposits in fewer transports than conventional coke oven systems. Fewer transports free the flat push hot cars and ovens sooner so that coke production may continue, giving a coke plant a higher coke yield. Moreover, fewer transports also means less thermal and mechanical stress on the flat push hot cars, thus increasing their useful life.

EXAMPLES

1. A hot car for use in a coke plant, the hot car comprising:
   an at least partially enclosed hot box having an interior portion, an exterior portion, a base, and a sidewall extending upward from the base; and
   a fluid distribution system coupled to the hot box, the fluid distribution system comprising a plurality of fluid inlets configured to release a fluid directed toward the sidewall of the interior portion.

2. The hot car of example 1, further comprising a reservoir in fluid communication with the fluid distribution system and configured to contain fluid.

3. The hot car of example 1 wherein at least a portion of the fluid distribution system is positioned within at least one of the sidewalls.

4. The hot car of example 1 wherein at least a portion of the fluid distribution system is positioned within the base.

5. The hot car of example 1 wherein the interior portion comprises a peripheral portion proximate to the sidewalls and a central portion spaced apart from the sidewalls, and wherein the fluid inlets are positioned in the peripheral portion.

6. The hot car of example 1 wherein individual fluid inlets comprise a nozzle configured to direct fluid toward the sidewalls.

7. The hot car of example 1 wherein the hot box comprises a top portion at least partially covering the interior portion of the hot box, wherein the plurality of fluid inlets are spaced apart from the top portion.

8. The hot car of example 1 wherein at least one fluid inlet is coupled to a sidewall.

9. The hot car of example 1, further comprising an elevation and translation mechanism.

10. The hot car of example 1 wherein the fluid comprises water.

11. The hot car of example 1 wherein the fluid inlets are evenly spaced along two substantially parallel rows along a longitudinal axis of the hot box.

12. The hot car of example 1 wherein the fluid inlets are positioned along a crosspiece extending along a width of the hot box.

13. The hot car of example 1, further comprising a fluid source operably connected to the fluid distribution system.

14. A method of cooling a hot car in a coke production system, the method comprising:

introducing fluid to a fluid distribution system coupled to the hot car, wherein the hot car comprises a car base and a plurality of car sidewalls extending upward from the car base;

directing fluid from the fluid distribution system toward the sidewalls; and cooling the sidewalls.

15. The method of example 14, further comprising releasing the fluid through one or more apertures in the hot car after the fluid has interfaced with the sidewalls.

16. The method of example 14 wherein directing fluid from the fluid distribution system toward the sidewalls comprises directing fluid through an array of nozzles.

17. The method of example 14 wherein directing fluid from the fluid distribution system toward the sidewalls comprises directing fluid through a plurality of inlet pipes proximate to the sidewalls.

18. The method of example 14 wherein introducing fluid to the fluid distribution system comprises introducing fluid from a fluid reservoir carried by the hot car.

19. The method of example 14 wherein directing fluid from the fluid distribution system toward the sidewalls comprises directing the fluid using a gravity-feed system.

20. The method of example 14 wherein directing fluid from the fluid distribution system toward the sidewalls comprises directing pressurized fluid toward the sidewalls.

21. A system for cooling a hot box, wherein the hot box has an interior surface comprising a floor and at least two sidewalls, the system comprising:

a fluid source;

a supply conduit coupled to the fluid source;

a spray manifold carried by the hot box and in fluid communication with the supply conduit; and a dispenser coupled to the spray manifold, wherein the dispenser is configured to direct a fluid onto an interior surface of a hot box.

22. The system of example 21 wherein the dispenser comprises one or more of a flat fan nozzle, flood nozzle, raindrop nozzle, hollow-cone nozzle, full-cone nozzle, or directional or bi-directional nozzle.

23. The system of example 21, further comprising a fluid collection system configured to collect the fluid for at least one of reuse and disposal.

24. The system of example 21 wherein the hot box is coupled to at least one of a hot car and a hot train.

25. The system of example 21 wherein the hot box has an exterior surface, and wherein the dispenser is configured to direct a fluid onto at least one of an exterior surface and the interior surface.

The present technology offers several additional advantages over traditional systems. For example, the steel plates within the hot car may begin the cooling process sooner, thus extending the useful life of the steel plates and reducing the frequency of steel plate changes. Further, use of a fluid distribution system requires fewer people to start the cooling process. In several embodiments, the present system is able to cool the hot box while simultaneously decarbing the ovens.

Examples of suitable flat push hot cars are described in U.S. Pat. No. 8,152,970, filed Mar. 3, 2006, incorporated herein by reference in its entirety. Other suitable technologies are described in U.S. Pat. No. 7,998,316, filed Mar. 17, 2009 and U.S. patent application Ser. No. 13/205,960, filed Aug. 9, 2011, each of which are incorporated herein by reference in their entireties.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

We claim:

1. A hot car for use in a coke plant, the hot car comprising:

an at least partially enclosed hot box having an interior portion, an exterior portion, a base, a pair of opposing sidewalls extending upward from the base; and a ceiling extending between the opposing sidewalls and a fluid distribution system coupled to the hot box, the fluid distribution system comprising a plurality of fluid inlets configured to release a fluid toward and at least partially onto at least one of the sidewalls of the interior portion and at least one fluid inlet positioned outside of the interior portion of the hot box and configured to release fluid directly onto an exterior of at least one of the sidewalls; at least a portion the fluid distribution system being positioned along the ceiling so that a plurality of the fluid inlets depend from the ceiling above the base and are positioned in a spaced-apart relationship with the ceiling and the at least one of the sidewalls onto which the fluid will be released;

at least some of the inlets being aimed to direct the fluid onto at least one of the sidewalls and the base.

2. The hot car of claim 1, further comprising a reservoir in fluid communication with the fluid distribution system and configured to contain fluid.

3. The hot car of claim 1 wherein at least a portion of the fluid distribution system is positioned within at least one of the sidewalls.

4. The hot car of claim 1 wherein at least a portion of the fluid distribution system is positioned within the base.

5. The hot car of claim 1 wherein the interior portion comprises a peripheral portion adjacent the sidewalls and a central portion spaced inwardly from the peripheral portion, and wherein the fluid inlets are positioned in the peripheral portion, in a spaced-apart relationship with at least one of the sidewalls.

6. The hot car of claim 1 wherein individual fluid inlets comprise a nozzle configured to direct fluid toward the sidewalls.

7. The hot car of claim 1 wherein the hot box comprises a top portion at least partially covering the interior portion of the hot box, wherein the plurality of fluid inlets are spaced apart from the top portion.

8. The hot car of claim 1 wherein at least one fluid inlet is coupled to a sidewall.

9. The hot car of claim 1, further comprising an elevation and translation mechanism having a plurality of support arms pivotably coupled with the hot car and the hot box; the support arms configured to alter the elevation and position of the hot box with respect to structures adjacent the hot car.

10. The hot car of claim 1 wherein the fluid comprises water.

11. The hot car of claim 1 wherein the fluid inlets are evenly spaced along two substantially parallel rows along a longitudinal axis of the hot box.

12. The hot car of claim 1 wherein the fluid inlets are positioned along a crosspiece extending along a width of the hot box.

13. The hot car of claim 1, further comprising a fluid source operably connected to the fluid distribution system.

14. A system for cooling a hot box, wherein the hot box has an interior surface comprising a floor and at least two sidewalls, the system comprising:

a fluid source;

a supply conduit coupled to the fluid source;

a spray manifold carried by the hot box and in fluid communication with the supply conduit; and a plurality of dispensers coupled to the spray manifold, adjacent to and depending from a ceiling of the hot box above a base of the hot box, wherein at least one of the dispensers is positioned in a spaced-apart relationship with, and configured to direct a fluid onto, an interior surface of at least one of the sidewalls of the hot box and at least one of the dispensers is positioned outside of the interior portion of the hot box, in a spaced-apart relationship with, and configured to dispense a fluid directly onto an exterior surface of at least one of the sidewalls.

15. The system of claim 14 wherein the plurality of dispensers comprises one or more of a flat fan nozzle, flood nozzle, raindrop nozzle, hollow-cone nozzle, full-cone nozzle, or directional or bi-directional nozzle.

16. The system of claim 14, further comprising a fluid collection system comprising a filter configured to collect the fluid for at least one of reuse and disposal.

17. The system of claim 14 wherein the hot box is coupled to at least one of a hot car and a hot train.

18. The system of claim 16, wherein the fluid collection system further comprises a pump in fluid communication with the filter and the spray manifold and configured to deliver the collected fluid from the filter to the spray manifold for reuse.

* * * * *